US009624750B2

(12) United States Patent
Entchev et al.

(10) Patent No.: US 9,624,750 B2
(45) Date of Patent: Apr. 18, 2017

(54) SYSTEMS AND METHODS OF DIVERTING FLUIDS IN A WELLBORE USING DESTRUCTIBLE PLUGS

(75) Inventors: Pavlin B. Entchev, Houston, TX (US); William A. Sorem, Katy, TX (US); Zhihua Wang, Stavanger (NO); David A. Baker, Bellaire, TX (US); John K. Montgomery, Houston, TX (US); Larry Mercer, Doha (QA); Dennis H. Petrie, Sugar Land, TX (US)

(73) Assignees: EXXONMOBIL UPSTREAM RESEARCH COMPANY, Houston, TX (US); RASGAS COMPANY LIMITED, Doha (QA)

( * ) Notice: Subject to any disclaimer, the term of this patent is extended or adjusted under 35 U.S.C. 154(b) by 660 days.

(21) Appl. No.: 13/264,948

(22) PCT Filed: Apr. 13, 2010

(86) PCT No.: PCT/US2010/030886

§ 371 (c)(1),
(2), (4) Date: Jan. 9, 2012

(87) PCT Pub. No.: WO2010/120774

PCT Pub. Date: Oct. 21, 2010

(65) Prior Publication Data

US 2012/0125631 A1 May 24, 2012

Related U.S. Application Data

(60) Provisional application No. 61/170,177, filed on Apr. 17, 2009.

(51) Int. Cl.
*E21B 33/12* (2006.01)
*E21B 37/00* (2006.01)
(Continued)

(52) U.S. Cl.
CPC ..... *E21B 33/12* (2013.01); *E21B 17/1078* (2013.01); *E21B 29/00* (2013.01);
(Continued)

(58) Field of Classification Search
CPC ..... E21B 34/063; E21B 33/12; E21B 29/00; E21B 17/00; E21B 37/00; E21B 17/1078; Y10T 29/49796; B23P 17/00
(Continued)

(56) References Cited

U.S. PATENT DOCUMENTS 1,411,486 A * 4/1922 Gallagher ..... 166/115
3,289,762 A 6/1966 Schell et al.
(Continued)

FOREIGN PATENT DOCUMENTS

CA 2587395 A1 6/2005

OTHER PUBLICATIONS

Swor, L. et al., "Self-Removing Frangible Bridge and Fracture Plugs", SPE 102994, Sep. 24-27, 2006 SPE Annual Technical Conference, pp. 1-12, San Antonio, TX.
(Continued)

*Primary Examiner* — Yong-Suk (Philip) Ro
(74) *Attorney, Agent, or Firm* — Roberts Mlotkowski Safran Cole & Calderon, P.C.

(57) ABSTRACT

A bridge plug arrangement includes a plug having an upper end and a bottom end. The bridge plug arrangement also optionally includes a cylindrical seat. The bridge plug arrangement further includes a tubular member. The tubular member may be part of a casing string. The tubular member is configured to receive the plug and, when used, the seat. The plug and/or the seat may be fabricated from a frangible material. Also disclosed is a method for diverting fluids in a wellbore using the bridge plug arrangement. The method may include landing the plug onto the seat within the
(Continued)

wellbore below a subsurface zone of interest. Treatment fluids are then injected into the wellbore, where they are diverted through perforations and into a formation. The plug and/or seat is then optionally broken into a plurality of pieces through use of a downward mechanical force.

50 Claims, 13 Drawing Sheets

(51) Int. Cl.
*E21B 17/10* (2006.01)
*E21B 29/00* (2006.01)
*E21B 34/06* (2006.01)

(52) U.S. Cl.
CPC ..... *E21B 34/063* (2013.01); *E21B 37/00* (2013.01); *Y10T 29/49796* (2015.01)

(58) Field of Classification Search
USPC ..... 166/376, 386, 192, 307, 308.1, 100, 166/177.5, 305.1
See application file for complete search history.

(56) References Cited

U.S. PATENT DOCUMENTS 3,356,139 A * 12/1967 Lamb et al. ..... 166/119
3,420,305 A * 1/1969 Alexander et al. ..... 166/114
3,980,134 A 9/1976 Amancharla
4,368,894 A * 1/1983 Parmann ..... 277/615
4,469,173 A 9/1984 Gilbert et al.
4,637,468 A 1/1987 Derrick
4,691,775 A * 9/1987 Lustig et al. ..... 166/317
4,813,481 A * 3/1989 Sproul et al. ..... 166/51
4,844,154 A * 7/1989 Ross et al. ..... 166/139
4,969,515 A 11/1990 Dollison
4,969,524 A 11/1990 Whiteley
5,188,183 A 2/1993 Hopmann et al.
5,398,763 A 3/1995 Watson et al.
5,466,907 A 11/1995 Vuitton
5,479,986 A 1/1996 Gano et al.
5,685,372 A * 11/1997 Gano ..... 166/292
5,765,641 A 6/1998 Shy et al.
5,924,696 A * 7/1999 Frazier ..... 277/336
6,026,903 A 2/2000 Shy et al.
6,167,963 B1 * 1/2001 McMahan et al. ..... 166/179
6,276,398 B1 * 8/2001 Lange ..... 138/98
6,318,466 B1 11/2001 Ohmer et al.
6,341,653 B1 * 1/2002 Firmaniuk et al. ..... 166/311
6,394,184 B2 5/2002 Tolman et al.
6,397,950 B1 * 6/2002 Streich et al. ..... 166/376
6,422,148 B1 7/2002 Xu et al.
6,472,068 B1 10/2002 Glass et al.
6,491,108 B1 12/2002 Slup et al.
6,491,116 B2 12/2002 Berscheidt et al.
6,561,275 B2 5/2003 Glass et al.
6,578,633 B2 6/2003 Slup et al.
6,581,681 B1 6/2003 Zimmerman et al.
6,708,770 B2 3/2004 Slup et al.
6,796,376 B2 9/2004 Frazier
6,857,634 B2 * 2/2005 Araujo ..... 277/325
6,915,856 B2 7/2005 Gentry et al.
7,093,664 B2 8/2006 Todd et al.
7,210,533 B2 * 5/2007 Starr et al. ..... 166/376
7,513,311 B2 4/2009 Gramstad et al.
7,963,340 B2 6/2011 Gramstad et al.
2003/0188860 A1 10/2003 Zimmerman et al.
2005/0205266 A1 9/2005 Todd et al.
2005/0257936 A1 11/2005 Lehr
2007/0095527 A1 5/2007 Szarka
2007/0204986 A1 9/2007 Sorhus
2008/0066902 A1 * 3/2008 Bullard ..... 166/181
2008/0178938 A1 7/2008 Stokes et al.
2008/0190600 A1 * 8/2008 Shkurti et al. ..... 166/134
2010/0032151 A1 * 2/2010 Duphorne ..... E21B 23/02 166/55

OTHER PUBLICATIONS

International Search Report and Written Opinion for International Application No. PCT/US2010/030886.

* cited by examiner 315
312
317
310
344
316
314
318
325
320
322
332
336
335
337
330
338
334
350
300
345
342
340
344
343
348
346

SYSTEMS AND METHODS OF DIVERTING FLUIDS IN A WELLBORE USING DESTRUCTIBLE PLUGS

CROSS REFERENCE TO RELATED APPLICATIONS

This application claims the benefit of U.S. Provisional Application No. 61/170,177, filed 17 Apr. 2009, the entirety of which is incorporated herein by reference for all purposes.

BACKGROUND

Field

The present invention relates to the field of hydrocarbon recovery procedures. More specifically, the present invention relates to the isolation of a subsurface formation using an improved bridge plug arrangement for the purpose of injecting fluids.

Discussion of Technology

In the drilling of oil and gas wells, a wellbore is formed using a drill bit that is urged downwardly at a lower end of a drill string. After drilling to a predetermined depth, the drill string and bit are removed and the wellbore is lined with a string of casing. An annular area is thus formed between the string of casing and the formation. A cementing operation is typically conducted in order to fill or "squeeze" the annular area with cement. The combination of cement and casing strengthens the wellbore and facilitates the isolation of certain areas of the formation behind the casing for the production of hydrocarbons.

It is common to place several strings of casing having progressively smaller outer diameters into the wellbore. Thus, the process of drilling and then cementing progressively smaller strings of casing is repeated several times until the well has reached total depth. The final string of casing, referred to as a production casing, is cemented into place. In some instances, the final string of casing is a liner, that is, a string of casing that is not tied back to the surface.

As part of the completion process, the production casing or liner is perforated at a desired level (or levels). Additionally or alternatively, a sand screen may be employed depending on the conditions of the well and the formation. Either option provides fluid communication between the wellbore and a selected zone in a formation. In addition, production equipment such as tubing, packers and pumps may be installed within the wellbore. A wellhead is installed at the surface along with fluid gathering and processing equipment. Production operations may then commence.

Before beginning production, it is sometimes desirable for the drilling company to "stimulate" the formation by injecting an acid solution through the perforations. This is particularly true when the formation comprises carbonate rock. The drilling company typically injects a concentrated formic acid or other acidic composition into the wellbore, and directs the fluid into the zone of interest. This is known as acidizing. The acid helps to dissolve carbonate material, thereby opening up porous channels through which hydrocarbon fluids may flow into the wellbore. In addition, the acid helps to dissolve drilling mud that may have invaded the formation. Thus, acidizing may increase the effective diameter of the wellbore.

After a period of time, production from the zone of interest may begin to taper off. When this occurs, it is sometimes possible to restore the production rate of hydrocarbons by perforating the casing at a new zone of interest at a more shallow depth within the formation. The new zone of interest (or new formation as the case may be), may also undergo acidizing so as to increase permeability of the rock.

To direct the acidizing solution into the new zone of interest, it is desirable to temporarily seal off the wellbore below the new zone of interest to prevent the acidizing solution from preferentially invading the original formation therebelow. To do this, the operator will employ a fluid diversion technique. Two general categories of fluid diversion have been developed to help ensure that the acid reaches the desired rock matrix—mechanical and chemical. Mechanical diversion involves the use of a physical or mechanical diverter that is placed within the wellbore. Chemical diversion, on the other hand, involves the injection of a fluid or particles into the formation itself.

Referring first to chemical diverters, chemical diverters include foams, particulates, gels, and viscosified fluids. Foam commonly comprises a dispersion of gas and liquid wherein a gas is in a non-continuous phase and liquid is in a continuous phase. Where acid is used as the liquid phase, the mixture is referred to as a foamed acid. In either event, as the foam mixture is pumped downhole and into the porous medium that comprises the original, more permeable formation, additional foam is generated. The foam initially builds up in the areas of high permeability until it provides enough resistance to force the acid into the new zone of interest having a lower permeability. The acid is then able to open up pores and channels in the new formation.

Particulate diverters consist of fine particles. Examples of known particulate diverters are cellophane flakes, oyster shells, crushed limestone, gilsonite, oil-soluble naphthalenes, and even chicken feed. Within the last several years, solid organic acids such as lactic acid flakes have been used. As the particles are injected, they form a low permeability filter-cake on the face of wormholes and other areas of high permeability in the original formation. This then forces acid treatment to enter the new zone(s) of interest. After the acidizing treatment is completed, the particulates hydrolyze in the presence of water and are converted into acid.

Viscous diverters are highly viscous materials, sometimes referred to as gels. Gels use either a polymer or a viscoelastic surfactant (VES) to provide the needed viscosity. Polymer-based diverters crosslink to form a viscous network upon reaction with the formation. The crosslink breaks upon continued reaction and/or with an internal breaker. VES-based diverters increase viscosity by a change in micelle structure upon reaction with the formation. As the high-viscosity material is injected into the formation, it fills existing wormholes. This allows acid to be injected into areas of lower permeability higher in the wellbore. The viscosity of the gel breaks upon exposure to hydrocarbons (on flowback) or upon contact with a solvent.

Referring now to mechanical diverters, various types of mechanical diverters have been employed. These generally include ball sealers, plugs, and straddle packers. For example, U.S. Pat. No. 3,289,762 uses a ball that seats in a baffle to cause mechanical isolation. U.S. Pat. No. 5,398,763 uses a wireline to set and then to retrieve a baffle. The baffle isolates a portion of a formation for the injection of fluids. U.S. Pat. No. 6,491,116 provides a fracturing plug, or "frac plug." Frac plugs are common in the industry and rely upon a ball that is either dropped from the surface to land on a seat, or that is integral to the plug itself. Frac plugs generally require a wireline for setting. Frac plugs may also be retrieved via wireline, although in some instances frac plugs have been fabricated from materials that can be drilled out. Drilling out the material adds time and expense to the stimulation operation.

The concept of destructible plugs has also been introduced to the industry. SPE Paper No. 102,994-MS teaches an internal explosive that causes a plug to fall into the rat hole. See L. Swor and A. Sonnefeld, Self-Removing Frangible Bridge Plug and Fracture Plug, Society of Petroleum Engineers Paper No. 102,994-MS (2006). The plug is set on wireline, used for fluid diversion, and destroyed using internal timed explosives that are activated at the surface. The plug will detonate at a set time downhole and there is no stopping it if other issues arise. U.S. Pat. No. 5,924,696 presents a frangible pressure seal that is used in conjunction with packers and sealing members and a shoulder-type seat. Other systems use a plug that incorporates high strength glass as part of the mechanical isolation. The plug contains an explosive element that is detonated remotely. These systems typically result in a permanent restriction in the wellbore due to the presence of the seat. They also have the complexity of running the plug and then using explosives for detonation.

U.S. Publication No. 2007/0204986 A1 discloses a tubing plug that must be preinstalled in a premium connection. Removing it requires drilling or milling for removal, similar to cast-iron bridge plugs. Milling and drilling are expensive, risky, and time consuming operations. To form a hydraulic seal, the plug relies upon a seal bore assembly. The plug relies upon a premium pin and box assembly to support and retain the plug.

While mechanical plugs can provide high confidence that formation treatment fluid is being diverted, there is a risk of incurring high costs due to mechanical and operational complexity of the plugs. Plugs may become stuck in the casing resulting in a lengthy and costly fishing operation. If unsuccessful, a drill rig may be needed to be brought on-sight to drill the plug out. Drilling out the plug is not preferred due to the time and cost associated with mobilizing a drill rig on location. In some situations, the well may have to be sidetracked or even abandoned. Mechanical plugs particularly have a history of reliability issues in large diameter wells. In this respect, it can be difficult to locate a plug suitable for a large borehole, and those that are available have a history of failures.

SUMMARY

Various bridge plug arrangements are offered herein. In one aspect, the bridge plug arrangement first includes a plug fabricated from a frangible material. The frangible material may be, for example, a ceramic. However, the frangible material may also be glass, plastic, fired clay, rigid thermoplastic materials, or combinations thereof. The plug may in some embodiments comprise a metallic material however such embodiments would necessitate use of a metal component that was sufficiently frangible so as to acceptably break into pieces for removal, as desired. Consequently, metallic components are not excluded, although they may often not be the most preferred material. The plug has an upper end and a bottom end. The plug also has a first beveled edge along an outer diameter proximate the bottom end of the plug. In one aspect, the plug also has a bore for receiving a running tool. Alternatively, the plug is a solid body having a hook at the upper end for receiving the running tool.

In one arrangement, the plug is shaped as a disc. In this arrangement, the plug preferably further comprises a second beveled edge along an outer diameter proximate the upper end of the plug. The first beveled edge and the second beveled edge have substantially the same angle relative to the centerline. In this way, the plug is symmetrical.

In another arrangement, the plug defines a body that is shaped either as a dome or as a cone. Preferably, the body is assembled from a series of segments that are weakly joined together along joints, thereby accommodating the breakage of the plug downhole by application of a mechanical force. The joints may be bonded together through use of an adhesive such as epoxy.

Where the plug is shaped as a dome or a cone, the bottom end of the body defines an angle relative to the centerline of the plug. Preferably, the angle of the bottom end of the body is the same as the angle of the beveled inner diameter of the cylindrical seat. In this way, compressive forces applied to the body through hydraulic load allow the body to act against the hydraulic load with maximum strength.

The bridge plug arrangement further includes a tubular member. The tubular member is configured to receive the plug. The tubular member may be a joint of casing. Alternatively, and more preferably, the tubular member may be a pup joint having a length of about two to ten feet. The tubular member preferably has a threaded upper end and a threaded bottom end so that it may be part of a casing string. However, other connection options may be used.

The bridge plug arrangement also has a shoulder along an inner diameter of the tubular member. In one aspect, the shoulder is a reduced inner diameter portion machined into the tubular member. The first beveled edge of the plug rests upon the metal shoulder of the tubular member. The shoulder has a beveled angle that is substantially equivalent to the angle of the first beveled edge proximate the bottom end of the plug. In this way, the plug lands on the shoulder in a smooth and flush manner.

In another aspect, the shoulder is provided by a separate cylindrical seat. The cylindrical seat is landed into an enlarged outer diameter portion machined into the tubular member. The seat includes a beveled inner diameter proximate an upper end of the seat that serves as the shoulder for receiving the plug. The beveled inner diameter is configured to receive the first beveled edge of the plug in a flush manner.

In the alternate embodiment that uses a seat, the first beveled edge proximate the bottom end of the plug and the beveled inner diameter of the cylindrical seat each define an angle that is between 10 degrees and 75 degrees relative to a centerline through the tubular member. The angle of the first beveled edge proximate the bottom end of the plug and the angle of the beveled inner diameter of the cylindrical seat are substantially the same. Preferably, the angle is between about 15 degrees and 35 degrees relative to the centerline.

Additional bridge plug arrangements are offered. In one embodiment, the bridge plug arrangement includes a plug fabricated from a frangible material. The plug has an upper end and a bottom end. The plug also has a beveled edge along an outer diameter proximate the bottom end of the plug.

The bridge plug arrangement further includes a tubular member for receiving the plug. The tubular member has a threaded (or otherwise coupled) upper end and a threaded (or otherwise coupled) bottom end. The tubular member further comprises a reduced inner diameter portion defining a shoulder machined into the tubular member. The reduced inner diameter portion is configured to receive the beveled edge of the plug. In this way a mechanical seat is formed between the plug and the tubular member. The seat may form a substantial hydraulic seal, meaning the seat may provide merely a hydraulic restriction that allows for some fluid leakage or passage, or the seat may provide a nearperfect hydraulic seal that hydraulically isolates fluid and/or pressure above the plug from fluid and/or pressure below the plug.

In this bridge plug arrangement, the beveled edge proximate the bottom end of the plug and the shoulder along the tubular member each define an angle. Preferably, the angle is between 15 degrees and 75 degrees relative to a centerline through the tubular member. The angle of the beveled edge proximate the bottom end of the plug and the angle of the shoulder are substantially the same.

In another embodiment, the bridge plug arrangement again includes a plug having an upper end and a bottom end. The plug also comprises a beveled edge along an outer diameter proximate the bottom end of the plug. However, in this arrangement the plug may be fabricated from either a frangible or a non-frangible material.

The bridge plug arrangement further includes a cylindrical seat. The cylindrical seat is fabricated from a frangible member. The seat comprises a beveled inner diameter proximate an upper end of the seat. The seat further comprises a beveled outer diameter proximate a bottom end of the seat. The beveled inner diameter proximate the upper end of the seat is configured to receive the beveled edge proximate the bottom end of the plug. In this way, a substantial hydraulic seal between the plug and the seat is formed.

The bridge plug arrangement also includes a tubular member for receiving the seat. The tubular member has a threaded upper end and a threaded bottom end. The tubular member also has an enlarged inner diameter portion machined into the tubular member defining a recess. The recess offers a lower beveled edge configured to receive the beveled outer diameter of the bottom end of the seat. In this way a substantial hydraulic seal is further formed between the seat and the tubular member.

In this bridge plug arrangement, the beveled edge proximate the bottom end of the plug and the beveled inner diameter proximate the upper end of the seat each define an angle that is between about 15 degrees and 75 degrees relative to a centerline through the tubular member. The angle of the beveled edge proximate the bottom end of the plug and the angle of the beveled inner diameter proximate the upper end of the seat are substantially the same. In addition, the beveled outer diameter proximate the bottom end of the seat and the lower beveled edge within the recess of the tubular member each define an angle that is between about 15 degrees and 75 degrees relative to a centerline through the tubular member. The angle of the beveled outer diameter proximate the bottom end of the seat and the angle of the lower beveled edge within the recess of the tubular member are substantially the same.

A method for diverting fluids in a wellbore is also provided herein. In one aspect, the method includes providing a tubular member within a casing string. The tubular member comprises a beveled shoulder machined into an inner diameter of the tubular member. The method also includes running a plug into the wellbore. The plug has an upper end and a bottom end. The plug also has a beveled edge along an outer diameter proximate the bottom end of the plug.

The method also includes the step of setting the plug onto a seating shoulder below a subsurface zone of interest. The seating shoulder defines an angle relative to a centerline of the tubular member. The method includes injecting (defined broadly to include substantially any of introducing, circulating, injecting, filling, and/or merely pressure testing) fluids into the tubular member (e.g., tubing, tool, casing, or wellbore containing the seat), in either normal and/or reverse flow direction, as designed. The majority (at least half by rate) of the fluid is blocked from traveling below the plug, although some of the fluid may be permitted to leak or otherwise flow across the seat or through one or more orifices in the plug body if so designed. In some embodiments, a substantially perfect hydraulic seal may be perfected at the interface of the plug (e.g., at the beveled edge on the plug) and the plug seat. The blocked majority of fluids may be diverted through an aperture (slot, valve, by-pass, perforation, leaking connection, or other fluid opening) in the tubular member above the plug. Thereby, the blocked fluid may flow through the aperture to facilitate fluid flow, communication, circulation, stimulation, etc., such as into an annulus or into a formation or from a formation into the tubular member. Thereafter, the method may optionally include breaking the plug into pieces after injecting the fluid, or leaving the plug in place, or otherwise retrieving the plug.

The method also may include breaking the plug into a plurality of pieces through a downward mechanical force applied to the plug. The force may be applied using any convenient means, and may be applied at substantially any point (e.g., w/a dropped bar) or across the entirety of the surface area of the plug (e.g., w/fluid pressure, or using a mechanical or jarring force, such as around the perimeter) or combinations thereof. For example, the pressure may be applied at a central point, a random point or area, or at the perimeter of the plug, or combinations thereof. The broken pieces may be allowed to fall, such as into a rat hole (including casing, tubing, or open hole rat hole), such as but not limited to a cased rat hole, open hole rat hole, a bailer section or tubing tail section, a tool basket, or combinations thereof. The pieces may be abandoned, bailed out, milled up, or circulated out of the wellbore. If desired, a mill, reamer, gauge tool or similar device may subsequently be run to ensure all pieces are gone.

In one arrangement of the method, the plug is fabricated from a frangible material. In addition, the beveled shoulder in the tubular member is part of an enlarged inner diameter portion of the tubular member. In this arrangement, setting the plug onto a seating shoulder comprises landing the beveled edge of the plug onto the beveled shoulder of the tubular member. The angle of the beveled edge proximate the bottom end of the plug and the angle of the beveled shoulder of the tubular member are each between about 15 degrees and 75 degrees relative to the centerline.

In another arrangement of the method, the method includes the step of disposing a cylindrical seat onto the beveled shoulder of the tubular member prior to running the plug into the wellbore. Here, the seat is fabricated from a frangible material. The seat comprises a beveled inner diameter proximate an upper end of the seat, and a beveled outer diameter proximate a bottom end of the seat. In this arrangement, the beveled shoulder in the tubular member is part of an enlarged inner diameter portion of the tubular member. The enlarged inner diameter portion defines a recess such that the cylindrical seat resides within the recess.

In this arrangement, the seating shoulder defines the beveled inner diameter proximate the upper end of the cylindrical seat. Setting the plug onto a seating shoulder comprises landing the beveled edge of the plug onto the beveled inner diameter proximate the upper end of the seat.

BRIEF DESCRIPTION OF THE DRAWINGS

So that the manner in which the present invention can be better understood, certain illustrations, charts and/or flow charts are appended hereto. It is to be noted, however, that the drawings illustrate only selected embodiments of the inventions and are therefore not to be considered limiting of scope, for the inventions may admit to other equally effective embodiments and applications.

In FIG. 9A, a bridge plug arrangement with cooperating tool string is illustrated positioned in a wellbore.

In FIG. 9B, the jars have been actuated, creating a force "F," which drives the mandrel through the plug to break the plug into pieces.

In FIG. 9C, the mandrel has been driven through the plug to break the plug into pieces and the fragments are allowed to fall into the wellbore.

DETAILED DESCRIPTION

Definitions

Figure 1:
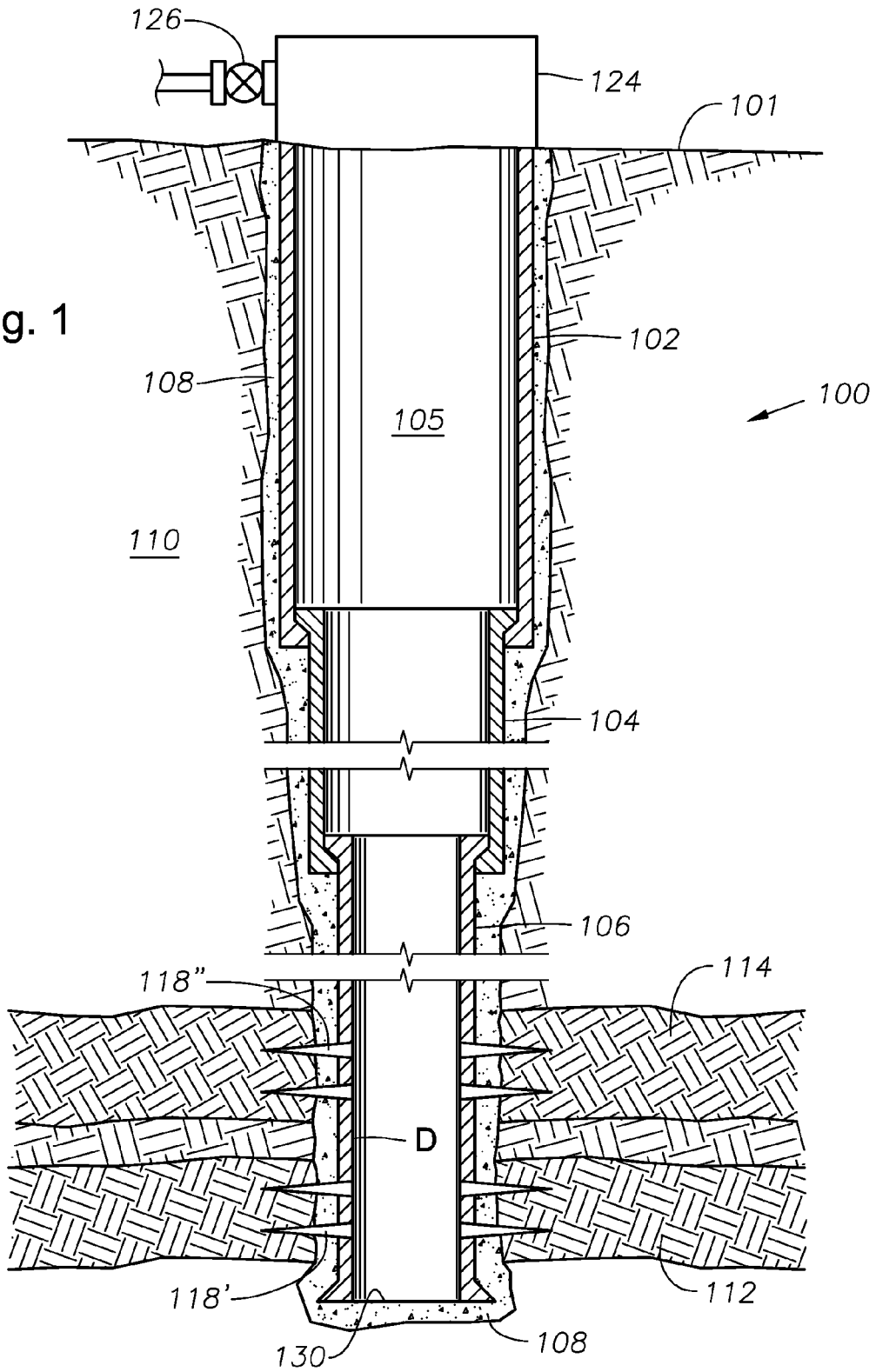
FIG. 1 is a cross-sectional view of an illustrative wellbore. The wellbore has been drilled through two different formations, each formation containing hydrocarbon fluids.

As used herein, the term "hydrocarbon" refers to an organic compound that includes primarily, if not exclusively, the elements hydrogen and carbon. Hydrocarbons generally fall into two classes: aliphatic, or straight chain hydrocarbons, and cyclic, or closed ring, hydrocarbons including cyclic terpenes. Examples of hydrocarbon-containing materials include any form of natural gas, oil, coal, and bitumen that can be used as a fuel or upgraded into a fuel.

The term "bridge plug" means any plug configured to be run into a wellbore and set in order to provide a seal between the plug and a lower portion of the wellbore.

As used herein, the term "subsurface" refers to geologic strata occurring below the earth's surface.

As used herein, the term "formation" refers to any definable subsurface region. The formation may contain one or more hydrocarbon-containing layers, one or more non-hydrocarbon containing layers, an overburden, and/or an underburden of any geologic formation.

The terms "zone" or "zone of interest" refers to a portion of a formation containing hydrocarbons.

As used herein, the term "wellbore" refers to a hole in the subsurface made by drilling or insertion of a conduit into the subsurface. A wellbore may have a substantially circular cross section, or other cross-sectional shapes. As used herein, the term "well", when referring to an opening in the formation, may be used interchangeably with the term "wellbore."

For purposes of the present disclosure, the terms "ceramic" or "ceramic material" may include oxides such as alumina and zirconia. Specific examples include bismuth strontium calcium copper oxide, silicon aluminium oxynitrides, uranium oxide, yttrium barium copper oxide, zinc oxide, and zirconium dioxide. "Ceramic" may also include non-oxides such as carbides, borides, nitrides and silicides. Specific examples include titanium carbide, silicon carbide, boron nitride, magnesium diboride, and silicon nitride. The term "ceramic" also includes composites, meaning particulate reinforced, combinations of oxides and non-oxides. Additional specific examples of ceramics include barium titanate, strontium titanate, ferrite, and lead zierconate titanate.

As used herein, the term "fluid" refers to gases, liquids, and combinations of gases and liquids, as well as to combinations of gases and solids, combinations of liquids and solids, and combinations of gases, liquids and solids.

The term "tubular member" refers to any pipe, such as a joint of casing, a portion of a liner, or a pup joint.

DESCRIPTION OF SPECIFIC EMBODIMENTS

Reference will now be made to exemplary embodiments and implementations. Alterations and further modifications of the inventive features described herein and additional applications of the principles of the invention as described herein, such as would occur to one skilled in the relevant art having possession of this disclosure, are to be considered within the scope of the invention. Further, before particular embodiments of the present invention are disclosed and described, it is to be understood that this invention is not limited to the particular process and materials disclosed herein as such may vary to some degree. Moreover, in the event that a particular aspect or feature is described in connection with a particular embodiment, such aspects and features may be found and/or implemented with other embodiments of the present invention where appropriate. Specific language may be used herein to describe the exemplary embodiments and implementations. It will nevertheless be understood that such descriptions, which may be specific to one or more embodiments or implementations, are intended to be illustrative only and for the purpose of describing one or more exemplary embodiments. Accordingly, no limitation of the scope of the invention is thereby intended, as the scope of the present invention will be defined only by the appended claims and equivalents thereof.

FIG. 1 is a cross-sectional view of an illustrative wellbore 100. The wellbore 100 defines a bore 105 that extends from a surface 101, and into the earth's subsurface 110. The wellbore 100 includes a wellhead shown schematically at 124. The wellbore 100 further includes a shut-in valve 126. The shut-in valve 126 controls the flow of production fluids from the wellbore 100.

The wellbore 100 has been completed by setting a series of pipes into the subsurface 110. These pipes include a first string of casing 102, sometimes known as surface casing or a conductor. These pipes also include a final string of casing 106, known as a production casing. The pipes also include one or more sets of intermediate casing 104. The present inventions are not limited to the type of completion casing used. Typically, each string of casing 102, 104, 106 is set in place through cement 108. In some instances, the casing strings may be liners or expandable tubings.

In the illustrative arrangement of FIG. 1, the wellbore 100 is drilled through two different formations 112, 114. Each formation 112, 114 contains hydrocarbon fluids that are sought to be produced through the bore 105 and to the surface 101. In practice, the lower formation 112 is typically produced first. This is accomplished by shooting a first set of perforations 118' through the production casing 106 and the surrounding cement 108. After a period of time, the upper formation 114 is produced. This is accomplished by shooting a second set of perforations 118" through the production casing 106 and the surrounding cement 108.

In one aspect, the first formation 112 is produced through the first set of perforations 118' for a period of time. Optionally, the second set of perforations 118" is not shot until production within the first formation 112 begins to taper off. Either way, it is desirable to stimulate the second formation 114 before production from that formation 114 commences. To do so, the present disclosure offers an improved bridge plug assembly and improved methods for diverting fluids in a wellbore. While the present systems and methods may be advantageously used in circumstances as described here (e.g., stimulating a previously un-perforated formation after production from a first formation begins to taper), the present systems and methods may similarly be used and/or adapted for use in any of the variety of circumstances in which fluid diversion within a wellbore may be desired.

Figure 2A:
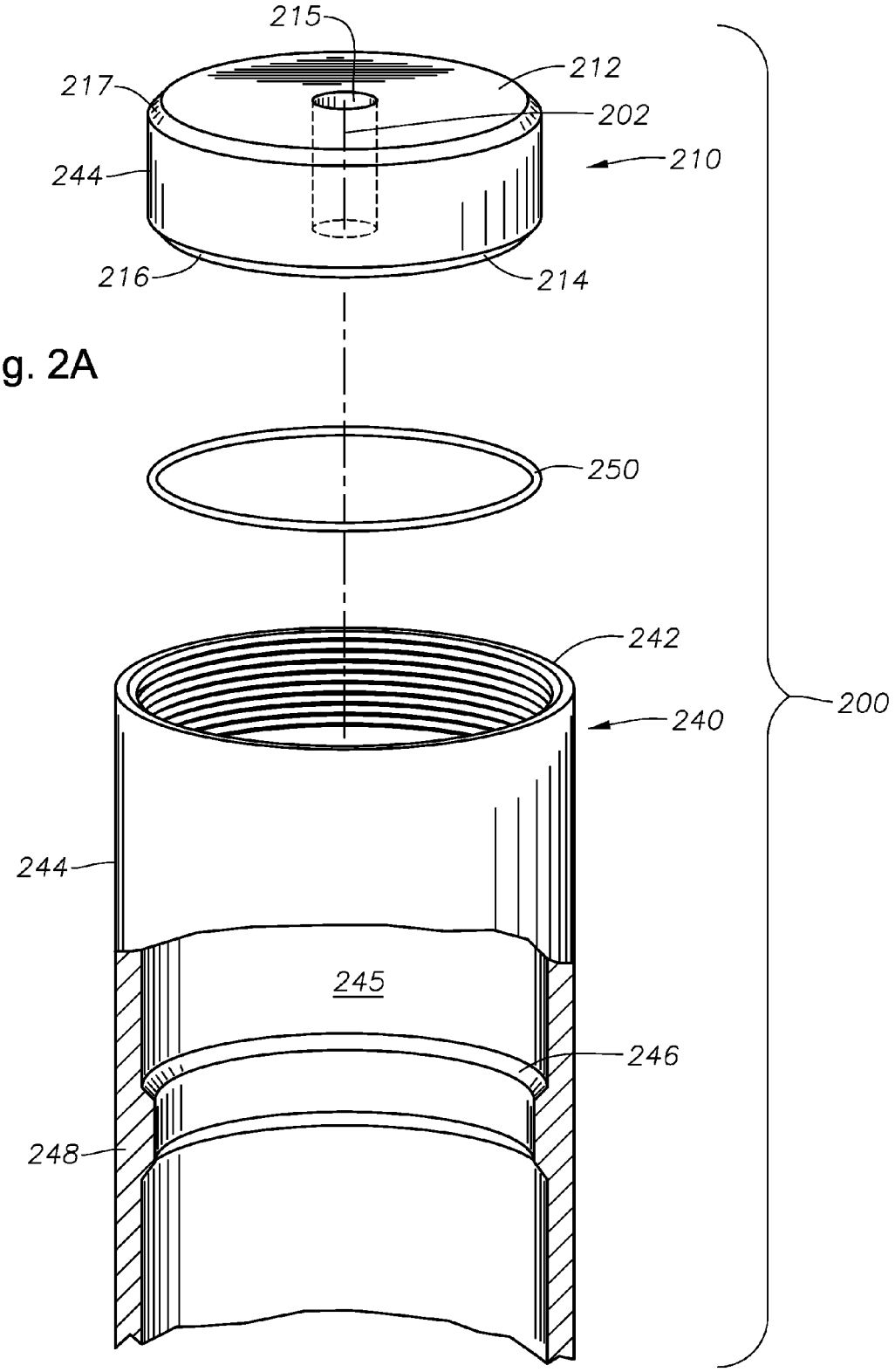
FIG. 2A is a perspective view of a bridge plug arrangement in accordance with the present invention, in one embodiment. Various components including a plug are shown in exploded-apart relation.

FIG. 2A is a perspective view of a bridge plug arrangement 200 in accordance with the present invention, in one embodiment. Components of the bridge plug arrangement 200 are shown in exploded-apart relation.

The bridge plug arrangement 200 comprises a plug. An illustrative plug is shown at 210. In this arrangement, the plug 210 is shaped as a disc. However, other plug shapes may be used as discussed further below. Such shapes include domes and cones.

The illustrative plug 210 has an upper end 212 and a bottom end 214. A cylindrical bore 215 is provided that extends from the upper end 212 to the bottom end 214. The bore 215 is configured to receive a running tool (not shown) for delivering the plug 210 to a selected depth within a wellbore, such as wellbore 100. The running tool may include a mandrel that is secured to the plug 210 through the bore 215. Other means of securing the mandrel to the plug may be implemented.

It can be seen in FIG. 2A that the bottom end 214 of the plug 210 has a beveled edge 216 machined into or otherwise formed in an outer diameter. Optionally, the upper end 212 also includes a beveled edge 217 machined into or otherwise formed in an outer diameter. In this way, the disc 210 is symmetrical. Such an arrangement insures that the disc 210 may be placed into the wellbore 100 without regard to which end is the bottom end 214.

The plug 210 is preferably fabricated from a frangible material. Suitable examples include plastics and ceramics. Ceramic materials are preferred since they generally have a high compressive strength and can withstand the downhole differential pressures placed on the plug 210. At the same time, ceramic materials are brittle or frangible and are, therefore, relatively weak in tension such that they can be readily destroyed if needed or desired. For example, a frangible material allows the plug 210 to be broken into pieces in accordance with certain methods herein, whereupon the pieces drop into the well rat hole 130. Preferred ceramic materials include CoorsTek™ AD94 and AD995 alumina silicate, available from CoorsTek of Golden, Colo. Ceramic plugs may be fabricated to within tolerances of +/−0.001 inches for bearing surfaces. Ceramics can be shaped or formed to suitable configurations through a variety of techniques. As used herein, the term 'machining'refers generally to the variety of methods for configuring the ceramics of the plug (or other components of the present disclosure). Similarly, plastics and other frangible material that may be used in the plug and other components may be manufactured and/or configured using techniques appropriate for the specific materials.

The bridge plug arrangement 200 also comprises a tubular member 240. The tubular member 240 defines an elongated cylindrical body 244 having a bore 245 therethrough. In the perspective view of FIG. 2A, an upper end 242 of the tubular member 240 is seen, with the upper end 242 having threads. It is understood that the tubular member 240 may also have a lower threaded end. The threads allow the tubular member 240 to be threadedly connected to a string of casing 106 within the wellbore 100. However, other connection arrangements may be employed.

The tubular member 240 may be a joint of casing. In that instance, the tubular member 240 will be 29 to 40 feet in length. More preferably, the tubular member 240 is a short section of pipe, or coupling, such as a "pup joint" that is 2 to 10 feet in length. Preferably, the tubular member 240 carries the same tensile strength, burst rating, hoop stress rating, and other properties as a joint of casing.

The tubular member 240 is designed to be placed in series with the production casing 106. The tubular member 240 is then run into the wellbore 100 as part of the drilling process, and is cemented into the formation 110 as a permanent part of the wellbore 100 completion. For example, the tubular member 240 may be located at a depth "D" as shown in FIG. 1. In this way, the plug 210 may be landed within the tubular member 240 at the depth "D" and used to divert stimulation fluids into the upper formation 114 above the depth "D."

The bridge plug arrangement 200 also has a shoulder 246 along an inner diameter of the tubular member 240. In the arrangement of FIG. 2A, the shoulder 246 is created from an enlarged inner diameter portion 248 machined into the tubular member 240. In other implementations, the shoulder may be provided by a separate component distinct from the tubular member 240. Exemplary implementations of a shoulder being provided by a component distinct from the tubular member are described in more detail below, including implementations utilizing a seat adapted to cooperate with a tubular member. The shoulder 246 is dimensioned to receive the plug 210. More specifically, the shoulder 246 is dimensioned to receive the beveled edge 216 along the bottom end 214 of the plug 210. The plug 210 is run into the wellbore 100 and landed directly on the shoulder 246.

The shoulder 246 may be a stepped seating surface that sits at a 90 degree angle relative to a longitudinal axis of the tubular member 240. Preferably, however, the shoulder 246 defines a beveled edge forming a conical profile in the tubular member 240. This means that the shoulder 246 is angled and dimensioned to receive the first beveled edge 216 of the plug 210. The shoulder 246 has a beveled angle that is substantially equivalent to the angle of the first beveled edge 216 proximate the bottom end 214 of the plug 210. In this way, a substantial seal is provided between the portion of the wellbore 100 above the plug 210 and the portion of the wellbore 100 below the plug 210.

Optionally, an elastomeric ring 250 is placed between the beveled edge 216 and the shoulder 246 to help create a hydraulic seal. This may be particularly beneficial when the plug 210 is used as part of well treating operations, such as hydraulic fracturing.

The shoulder 246 may accept other downhole tools as well. These include a standard nipple profile that could accommodate subsequent use of a standard "no-go" plug. In any use, the shoulder 246 provides the requisite bearing surface for the plug 210 while not excessively restricting the wellbore 100 inner diameter. This allows for passage of other tools below the seating surface 246.

Figure 2B:
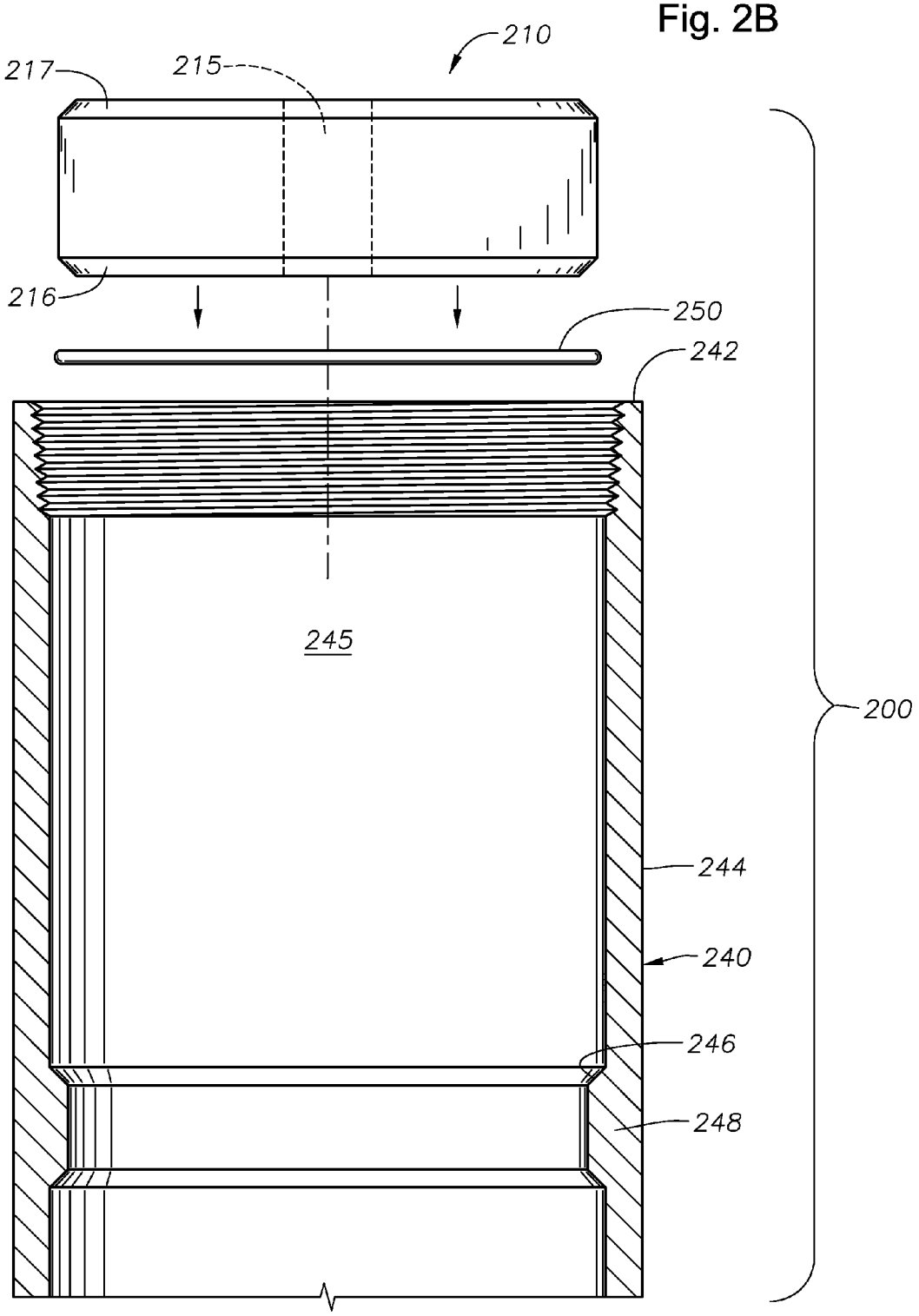
FIG. 2B is a cross-sectional side view of a tubular member that is part of the bridge plug arrangement of FIG. 2A. The plug is being lowered into the tubular member, again in exploded-apart relation.

FIG. 2B is a cross-sectional view of the tubular member 240 that is part of the bridge plug arrangement 200 of FIG. 2A. In this view, the body 244 of the tubular member 240 is more clearly seen, including the area 248 of the body 244 having an enlarged inner diameter. The shoulder 246 is seen at the top of reduced inner diameter portion 248.

The bridge plug arrangement 200 is shown in exploded-apart relation above the tubular member 240. The bridge plug 200 is ready to be landed on the shoulder 246. The intermediate elastomeric ring 250 is also seen between the bridge plug 200 and the shoulder 246.

As will be discussed further below, the plug 210 is run into the bore 105 of the wellbore 100 using a wireline or other run-in string, and a setting tool. The setting tool includes a mandrel that is received within the bore 215 of the plug 210. At the conclusion of a formation stimulation procedure, the plug 210 is preferably retrieved back to the surface 101 using the wireline. Alternatively, the plug 210 may be destroyed using a set of jars or a wireline spear.

The bridge plug arrangement 200 of FIGS. 2A and 2B provides a reliable mechanical diversion tool for diverting formation treatment fluids into a selected formation 114. Moreover, the bridge plug arrangement 200 offers a plug 210 that is frangible. In this way, the plug 210 can be quickly destroyed using a mechanical force in the event that the plug 210 becomes stuck while removing the plug 210 from the wellbore 100. The plug 210 is fabricated from an inexpensive material, e.g., ceramic, plastic or glass, such that there would be little negative economic consequence to losing the plug 210. Indeed, the plug 210 probably would not be re-used anyway. However, the bridge plug arrangement 200 does create a permanent, albeit small, restriction in the inner diameter of the wellbore 100. Thus, an alternate bridge plug arrangement is provided herein.

Figure 3A:
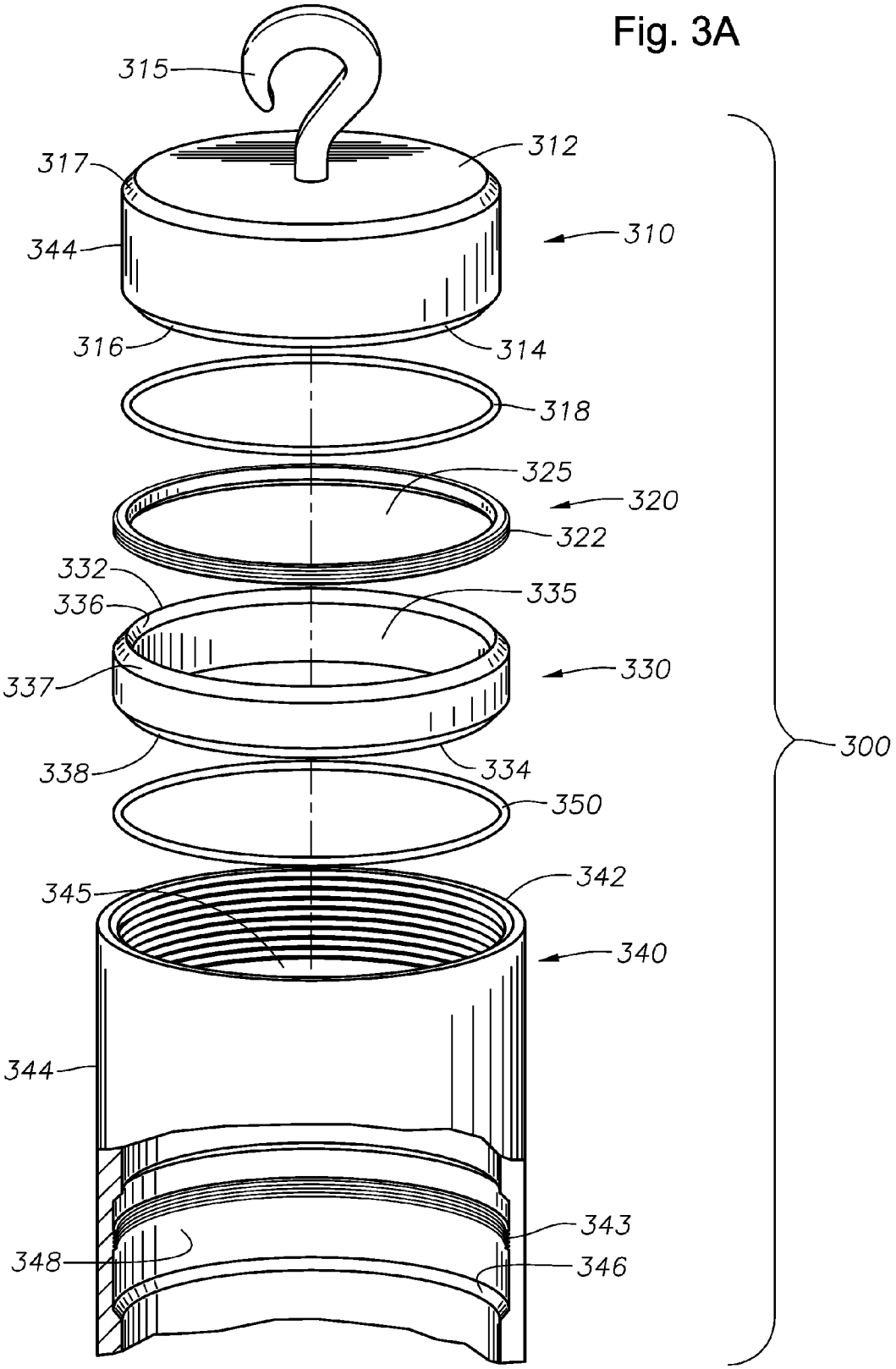
FIG. 3A is a perspective view of a bridge plug arrangement in accordance with the present invention, in an alternate embodiment. Here, a separate seat is used to form a shoulder for receiving the plug.
Figure 3B:
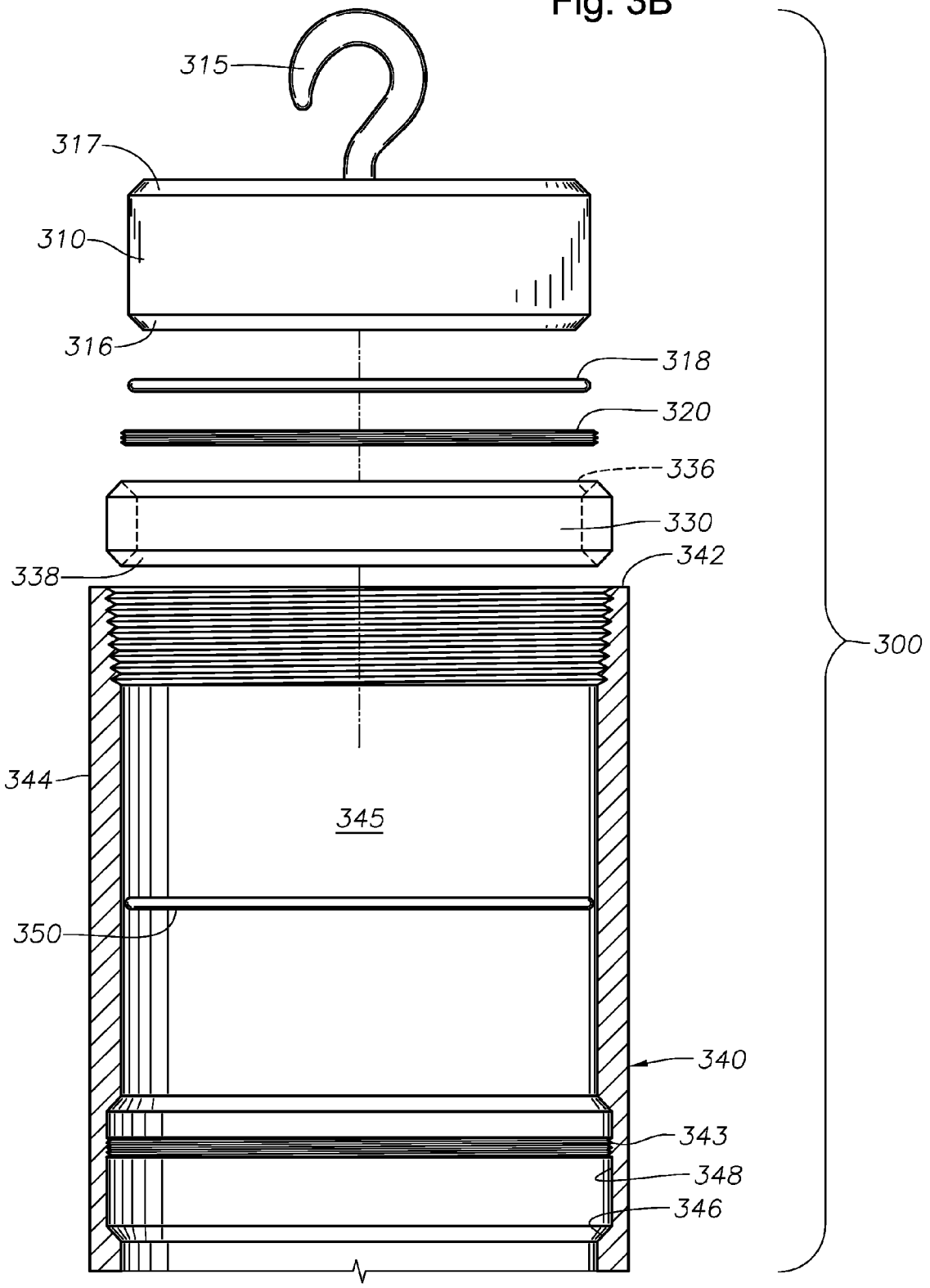
FIG. 3B is a cross-sectional side view of a tubular member that is part of the bridge plug arrangement of FIG. 3A. The plug is being lowered into the tubular member, again in exploded-apart relation.

FIG. 3A is a perspective view of a bridge plug arrangement 300 in accordance with the present invention, in an alternate embodiment. FIG. 3B is a cross-sectional view of the bridge plug arrangement 300 of FIG. 3B. Components of the bridge plug arrangement 300 are shown in exploded-apart relation. The bridge plug arrangement 300 will be discussed in connection with FIGS. 3A and 3B, together.

First, the bridge plug arrangement 300 again comprises a plug. An illustrative plug is shown at 310. In this arrangement, the plug 310 is again shaped as a disc. However, other plug shapes may be used. As with plug 210, plug 310 has an upper end 312 and a bottom end 314. However, the plug 310 does not utilize a cylindrical bore for accommodating a running tool; instead, the plug has a hook 315 on the upper end 312. The hook 315 is configured to receive a running tool (not shown) for delivering the plug 310 to a selected depth within a wellbore, such as wellbore 100. As suggested above, the plug and running tool may be associated in a variety of manners; the bore of FIG. 2A and the hook of FIGS. 3A and 3B are exemplary implementations.

The bottom end 314 of the plug 310 has a beveled edge 316 machined into an outer diameter. Optionally, the upper end 312 also includes a beveled edge 317 machined into an outer diameter. In this way, the disc 310 is symmetrical.

The plug 310 is preferably fabricated from a frangible material. However, plug 310 may alternatively be fabricated from a metal or composite or other non-frangible material.

The bridge plug arrangement 300 also comprises a tubular member 340. The tubular member 340 again defines an elongated cylindrical body 344 having a bore 345 therethrough. In the perspective view of FIG. 3A, an upper end 342 of the tubular member 340 is seen, with the upper end 342 having threads. It is understood that the tubular member 340 may also have a lower threaded end. The threads allow the tubular member 340 to be threadedly connected to a string of casing 106 within the wellbore 100. However, other connection arrangements may be employed.

The tubular member 340 may be a joint of casing. In that instance, the tubular member 340 will be 29 to 40 feet in length. More preferably, the tubular member 340 is a short section of pipe such as a "pup joint" that is about 2 to 10 feet in length. Preferably, the tubular member 340 carries the same tensile strength, burst rating, hoop stress rating, and other properties as a joint of casing.

The tubular member 340 is once again designed to be placed in series with the production casing 106. The tubular member 340 is then run into the wellbore 100 as part of the drilling process, and is cemented into the formation 110 as a permanent part of the wellbore 100 completion. For example, the tubular member 340 may be located at a depth "D" as shown in FIG. 1. In this way, the plug 310 may be landed within the tubular member 340 at the depth "D" and used to divert stimulation fluids into the upper formation 114.

As with bridge plug arrangement 200, bridge plug arrangement 300 also has a shoulder along an inner diameter of the tubular member 340. However, in the arrangement 300, the shoulder is created from a separate, non-integral seat. Such a non-integral seat is shown in FIGS. 3A and 3B at 330.

The seat 330 defines a cylindrical body having an upper end 332 and a bottom end 334. A bore 335 is provided that extends from the upper end 332 to the bottom end 334. A beveled edge 336 is provided along an inner diameter of the seat 330 proximate the upper end 332. Similarly, a beveled edge 338 is provided along an outer diameter of the seat 330 proximate the bottom end 334. The beveled edge 336 proximate the upper end 332 of the seat 330 is configured to receive the beveled edge 316 at the bottom end 314 of the plug 310. In this way, a hydraulic seal may be created within the wellbore 100. The hydraulic seal may be merely a fluid restriction that allow some fluid flow through or across the seal, or the seal may be a substantially completion hydraulic isolation across the seat, or substantially any range of hydraulic restriction between these embodiments.

The cylindrical seat 330 is landed into an enlarged inner diameter portion 348 machined into the tubular member 340. The enlarged inner diameter portion 348 includes a lower beveled edge 346. The beveled edge 338 proximate the bottom end 334 of the seat 330, in turn, is configured to land on the lower beveled edge 346 in the body 344 of the tubular member 340.

In one embodiment, the bridge plug arrangement 300 also includes a securement ring. An illustrative securement ring is shown at 320. The securement ring 320 defines an inner bore 325. The securement ring 320 further includes threads 322 along an outer diameter. The threads are configured to mate with threads 343 optionally machined into the tubular member 340. The securement ring 320 serves to hold the seat 330 in place on the lower beveled edge 346 within the tubular member 340.

In operation of the bridge plug arrangement 300, the seat 330 is installed in the tubular member 340 at the surface during the process of drilling the wellbore 100. The seat 330 is placed into the bore 345 of the tubular member 340 by hand, and landed on the shoulder 346. Thereafter, the securement ring 320 is lowered into the bore 345 of the tubular member 340. The securement ring 320 is rotated so as to engage the threads 322 of the ring 320 to the threads 343 of the tubular member 340. The securement ring 320 is then tightened down on or just above the seat 330. Threadedly connecting the securement ring 320 to the internal threads 343 will cause the securement ring 320 to be tightened down onto the upper end 332 of the seat 330. This, in turn, holds the seat 330 in place within the tubular member 340.

Preferably, an outer beveled edge 337 is provided along an outer diameter of the seat 330 proximate the upper end 332 for receiving the securement ring 320. In this way there is no interference between the securement ring 320 and the plug 310 as the plug 310 lands on the beveled edge 336 at the upper end 332 of the seat 330.

An elastomeric ring 318 may also be used as part of the bridge plug arrangement 300. The ring 318 is placed along the beveled edge 336 at the upper end 332 of the seat 330. This provides a hydraulic seal when the plug 310 is later landed on the seat 330. An optional elastomeric ring 350 is also seen in FIGS. 3A and 3B. While the ring 350 is shown exploded below the seat 330, it is understood that the ring 350 may be secured along the lower beveled edge 346 of the tubular member 340 before run-in. The elastomeric ring 350 provides a hydraulic seal between the bottom end 334 of the seat 330 and the lower beveled edge 346 of the tubular member 340. This, of course, applies when the separate seat 330 is used as part of the bridge plug arrangement 300.

Where a separate seat 330 is used as in the bridge plug arrangement 300 (as opposed to immediately landing the plug 210 on a shoulder 246 in the tubular member 240), the seat 330 is preferably fabricated from a frangible material. A preferred frangible material is ceramic, although plastic or glass materials may also be used. Because a frangible material is used, the seat 230 may then be destroyed by mechanical force when a fluid injection procedure is completed. This, in turn, allows the full inner diameter of the wellbore 100 to be restored.

Figure 4A:
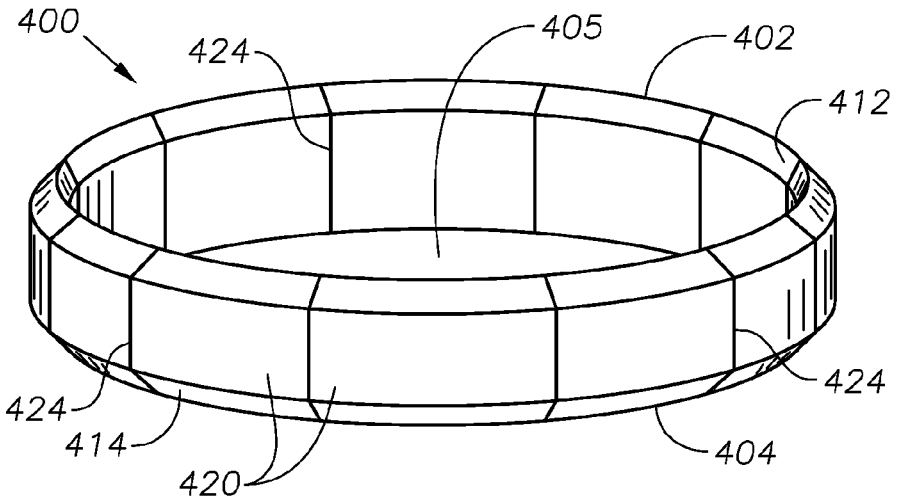
FIG. 4A is a perspective view of a seat that may be used as part of the bridge plug arrangement of FIG. 3A, in one embodiment.

To facilitate breaking the seat 230, the seat 230 may be fabricated by joining together a series of radial joints, with each joint being fabricated from the same or from different ceramic materials. Such an embodiment is demonstrated in FIG. 4A. FIG. 4A is a perspective view of a seat 400 that may be used as part of the bridge plug arrangement 300 of FIGS. 3A and 3B, in one embodiment. As can be seen, the seat 400 comprises an upper end 402, a lower end 404, and a bore 405 extending from the upper end 402 to the lower end 404.

The upper end 402 has a beveled edge 412 along an inner diameter. This is for receiving a plug such as plug 210 or 310. The lower end 404 has a beveled edge 414 along an outer diameter. This is for seating on a shoulder such as shoulder 246.

As illustrated, the seat 400 may comprise a plurality of radial segments 420. Each segment 420 is joined together at a joint 424. The joints 424 may be an interlocking arrangement such as a tongue-and-groove. Alternatively, the joints 424 may simply be scribes placed along the body of the seat 400. Alternatively still, and more preferably, the joints 424 may represent weakly cohesive bonds to hold separate segments 420 together during use.

In the latter instance, the seat 400 is fabricated from ceramic. In one method of fabricating the ceramic seat 400 from the set of joints 424, a starting seat is first molded to near-final dimensions. Next, the starting seat is cut along the radial direction into its separate segments 420. The process of cutting the starting seat will cause a loss of material from at least half of the segments. Therefore, more than one starting seat is molded and cut. Equalsize segments are next bonded together using an adhesive such as an epoxy. After the adhesive hardens, the seat is machined to final dimensions. The adhesive is strong enough to withstand the machining process. This produces the segmented seat 400. The end result is a ceramic ring with a preferential breakage pattern. Preferential breakage will occur along the bonded surfaces (joints 424), since the bonding agent will be chosen to be weaker than the ceramic material.

The purpose for the joints 424 is to provide a preferential breakage pattern for the seat 400 once the fluid diversion process is completed. In this respect, once fluid diversion into the upper formation 114 has taken place, it is desirable to remove the seat 400 and reopen the full wellbore 100 diameter. Breakage may be accomplished by dropping a spear through the wellbore 100, by milling through the seat 400, by detonating shaped charges through the seat 400, or other approaches. A sufficient number of joints 424 should be provided to enable the seat 400 to break into a number of small pieces so that no portion becomes stuck in the wellbore 100. Stated another way, all segments 420 should easily fall into the rat hole 130.

Another advantage of fabricating the seat 400 from segments 420, particularly segments that are separate pieces bonded together, is that the seat 400 can be installed into a tubular member, e.g., tubular member 340, even where the inner diameter of the tubular member 340 contains restrictions. This further allows the seat 400 to be placed along the tubular member 340 even though the outer diameter of the seat 400 is greater than an inner diameter of the tubular member 340. In this instance, the seat 400 may be disposed within a recess of the tubular member 240. This, in turn, allows the seat 400 to be easily destroyed, leaving the original wellbore diameter intact. This is demonstrated through FIGS. 4B, 5A and 5B.

Figure 4B:
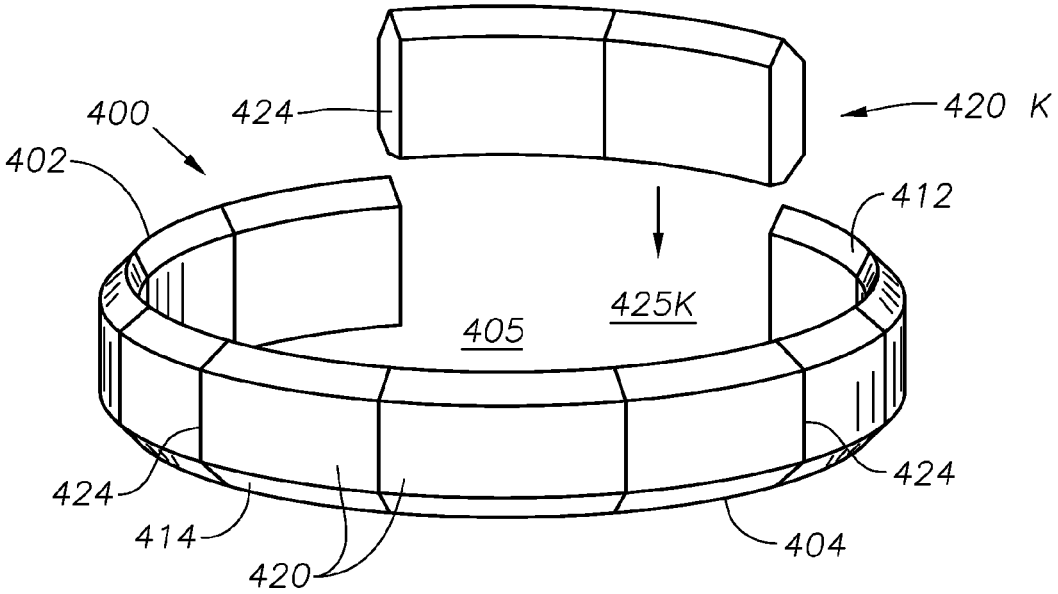
FIG. 4B shows the seat of FIG. 4A, with a keystone having been separated from the seat.

First, FIG. 4B provides a perspective view of the seat 400 of FIG. 4A, with a keystone 420K having been removed from the seat 400. The keystone 420K refers to one or more segments 420 that have been removed. This may be accomplished by cutting the adhesive material forming the corresponding joints. Alternatively, and more preferably, this may be accomplished by dissolving the adhesive used as the supporting joints for the keystone 420K. A solvent such as an acetone bath may be used. In FIG. 4B, a space 425K is shown where the segments 420 making up the keystone 420*k* previously resided.

Figure 5B:
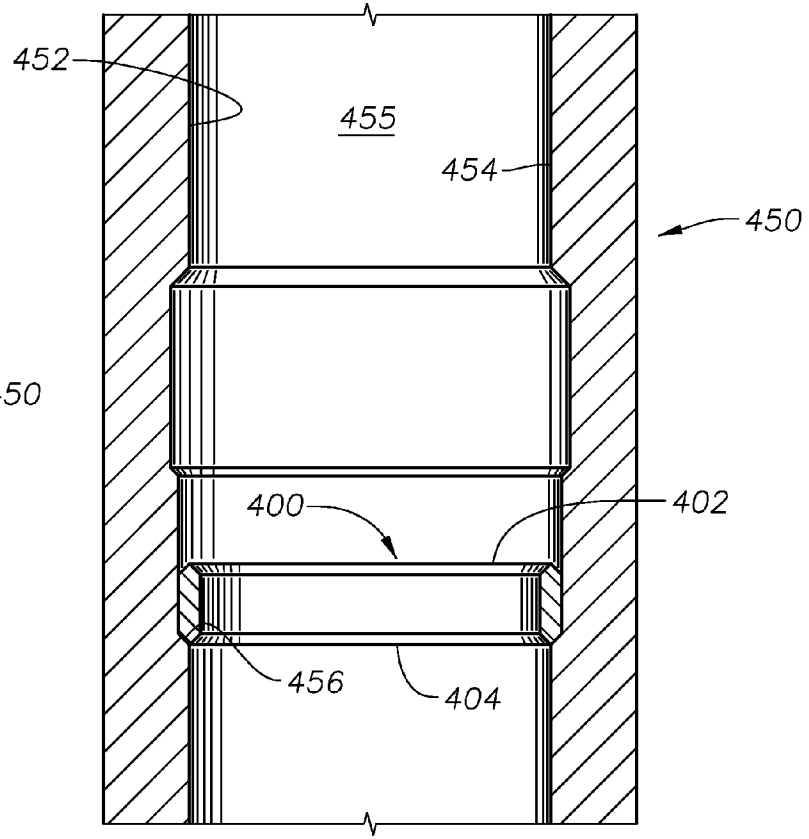
FIG. 5B is another side view of the tubular member of FIG. 5A. Here, the seat has been rotated and landed in an enlarged inner diameter portion machined into the inner diameter of the tubular member.
Figure 5A:
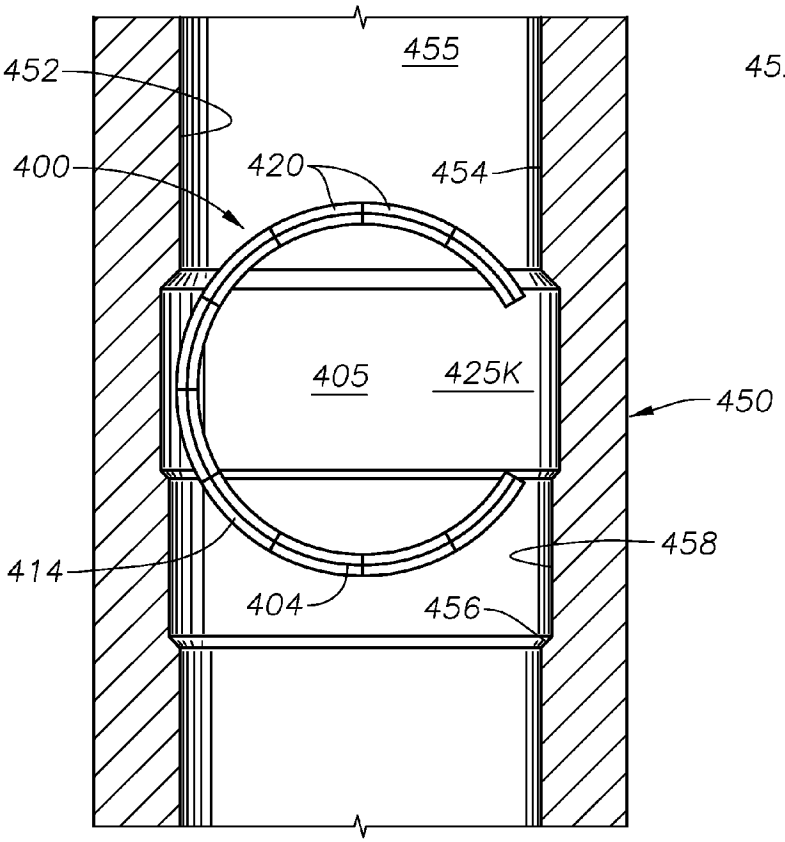
FIG. 5A is a side view of a tubular member as may be used in the bridge plug arrangement of FIG. 3A. Here, a seat such as the seat of FIG. 4B has been turned sideways and is being lowered down into the tubular member.

FIGS. 5A and 5B demonstrate one method for the placement of the seat 400 into a tubular member 450, wherein the tubular member 450 has an inner diameter that is smaller than the outer diameter of the seat 400. First, FIG. 5A is a side view of the tubular member 450. The tubular member 450 has a wall 452. The wall 452 includes a shoulder 456 where the beveled edge 414 at the bottom end 404 of the seat 400 is to land. The wall 452 of the tubular member 450 has an inner diameter that is smaller than the area where the seat 400 is to land. In this respect, a recess 458 is machined into the inner diameter of the tubular member 450.

In order to place the seat 400 onto the shoulder 456 in the tubular member 450, the seat 400 is rotated sideways. In FIG. 5A, it can be seen that the bore 405 of the seat 400 is coming "out of the page." The bottom end 404 of the seat is visible. Also in FIG. 5A, it can be seen that the seat 400 is divided into a plurality of segments 420. Originally, the seat had 12 segments. However, two of the segments have been removed, leaving a keystone space 425K. The two segments represent keystones 420K of FIG. 4B. Removal of the keystones 420*k* enables the operator to install the frangible seat 400 onto the shoulder 456.

FIG. 5B is a side view of the seat 400 of FIGS. 4B and 5A. Here, the seat 400 has landed on the step 456 machined into the inner diameter of the tubular member 450. A securement ring such as ring 320 may optionally be placed over the seat 400 before the tubular member 450 is installed into a string of casing such as production casing 106. In addition, the missing keystone segments 420*k* are placed in the keystone space 425K. These steps are done by hand before the tubular member 450 is run into the wellbore 100.

As noted above, a plug 210 may be landed immediately onto a shoulder in a tubular member (such as shoulder 456) without use of a separate seat. In this instance, the shoulder preferably comprises a beveled edge having an angle relative to a centerline of the tubular member, e.g., tubular member 240 that matches the angle of the beveled edge 216 of the plug 210. Such an arrangement is further demonstrated in FIGS. 6A and 6B.

Figure 6A:
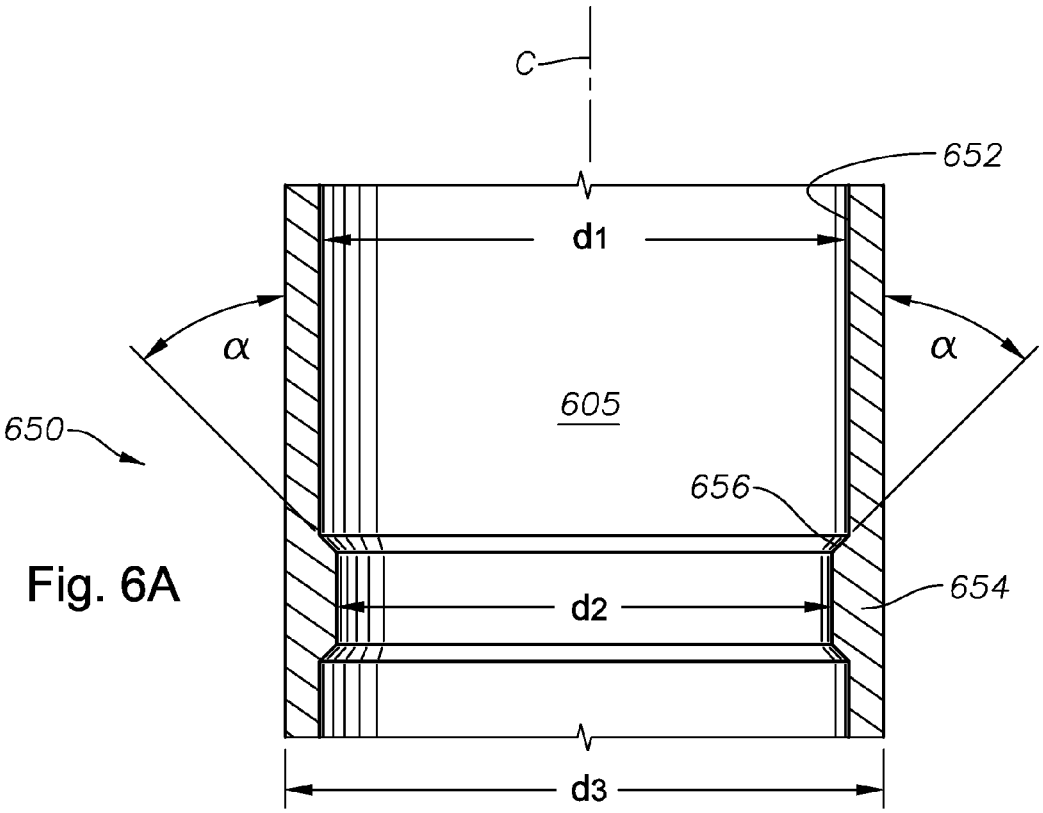
FIG. 6A is a cross-sectional view of a tubular member as might be used in a bridge plug arrangement, in an alternate embodiment.

First, FIG. 6A provides a cross-sectional view of a tubular member 650 as might be used in a bridge plug arrangement. The tubular member 650 includes a wall 652. The wall 652, in turn, has an inner diameter d1 that defines a bore 605. The bore 605 allows fluids to be injected into or produced from a subsurface formation, such as formations 112 and 114.

The tubular member 650 also has an outer diameter d3. The outer diameter d3 of the tubular member 650 is essentially constant. However, the inner diameter of the wall 652 is not. It can be seen in FIG. 6A that the wall 652 includes a portion wherein the inner diameter is reduced to d2. This portion forms a shoulder 656.

In the illustrative arrangement of FIG. 6A, the shoulder 656 has an illustrative angle $\alpha$ of approximately 25 degrees relative to a centerline "C." This angle $\alpha$ is large enough to "catch" a plug as it is being lowered into the wellbore 100, but slight enough to allow the plug to be destructed and dropped into the rat hole 130 at the bottom of the wellbore 100. It is understood that the angle $\alpha$ may be more or less than 25 degrees. For example, the angle $\alpha$ may be between 5 degrees and 75 degrees. More preferably, the angle $\alpha$ may be between about 15 degrees and 35 degrees.

Depending on the shape of the plug being used, it is also believed that the use of a matching beveled edge in the shoulder 656 helps provide strength to the plug during the fluid injection process. This means that whatever angle $\alpha$ is employed for the shoulder 656, it should substantially match the angle of the beveled edge (such as edge 216) provided at the lower end of the received plug. This principle is demonstrated in FIG. 6B.

Figure 6B:
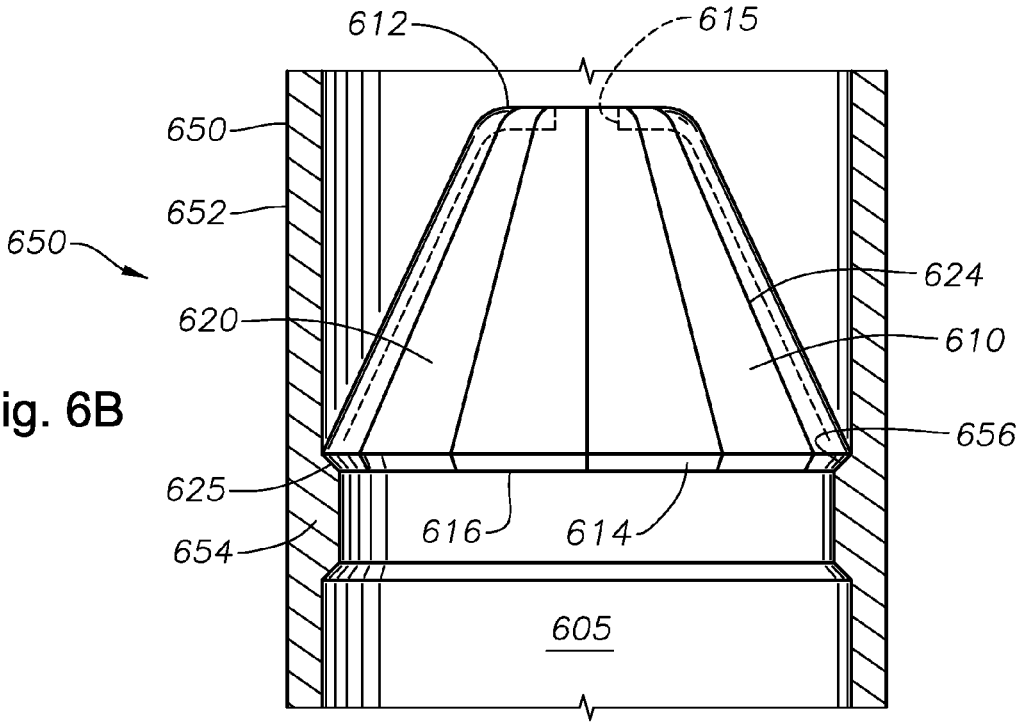
FIG. 6B is a cross-sectional view of the tubular member of FIG. 6A, with a plug having been landed on a seat machined into the inner diameter of the tubular member. Here, the plug is shaped as a cone.

FIG. 6B shows the tubular member 650 of FIG. 6A, with a plug 610 landed on the shoulder 656. This provides essentially a fluid seal between an upper portion of the tubular member 650 defined by the larger inner diameter d1 and a lower portion of the tubular member 650 defined by the smaller inner diameter d3. Thus, the shoulder 656 serves as a sealing surface to contain stimulation fluids.

Note that for an acidization operation it is usually not necessary to have a positive hydraulic seal between the plug 610 and the shoulder 656. The intent is only to divert a majority of injected stimulation fluids into the formation or subsurface zone of interest 114. However, it is within the scope of the present inventions to provide an elastomeric ring around the shoulder 656 to create a positive seal. For example, a rubber or plastic o-ring may be incorporated to create a positive hydraulic seal.

In the embodiment of FIG. 6B, the plug 610 is shaped like a cone. As with plug 210 of FIG. 2A, plug 610 defines a body that has an upper end 612 and a bottom end 614. The bottom end 614 of the plug 610 defines a beveled surface 616. The beveled surface 616 is angled in order to substantially match the angle $\alpha$ of shoulder 656.

The plug 610 also includes a bore 615, shown in phantom. The bore 615 extends through the top end 612. The bore 615 receives a mandrel that is part of a running tool (not shown). The running tool, in turn, is run into the wellbore 100 using a wireline, coiled tubing, or other device known in the art. The same running tool may optionally be used to remove the plug 610 from the wellbore 100.

In some instances, the operator may have difficulty removing the plug 610 from the wellbore 100. Alternatively, the operator may simply wish to break the plug 610 into pieces and let the pieces fall into the rat hole 130. Accordingly, it is desirable that the plug 610 be fabricated from a frangible material, such as the ceramic materials listed above. This allows the plug 610 to be broken into pieces.

To further assist in breaking the plug 610 into pieces, the plug 610 made be fabricated from a plurality of radial segments 620. The segments may be substantially equiradial with respect to each other or may be of differing segment radial sizes. Each segment 620 is joined together at a joint 624. The radial segments may individually and/or collectively provide the radial seat and beveled shoulder of the plug. The joints 624 may represent an interlocking arrangement such as a tongue-and-groove. Alternatively, and more preferably, the joints 624 may represent weakly cohesive bonds. Alternatively still, the joints 624 may simply be scribes placed along the body of the plug 610.

The purpose for the joints 624 is to provide a preferential breakage pattern for the plug 610 once the fluid diversion process is completed. In this respect, once fluid diversion into the upper formation 114 has taken place, it is desirable to remove the plug 610 and re-open the full wellbore 100 diameter. Removal of the plug 610 is accomplished by providing a mechanical force against the plug 610, such as through the use of jars or a spear, which breaks the plug 610 into its segments 620. A sufficient number of joints 624 should be provided to enable the plug 610 to break into a number of small pieces so that no portion becomes stuck in the wellbore 100. Stated another way, all segments 624 should easily fall into the rat hole 130.

It is noted that the cone-shaped plug provided in FIG. 6B, while being frangible along the joints 624, nevertheless has sufficient strength to withstand the hydrostatic loading taking place downhole. During hydrostatic loading, the segments 620 will be compressed together to provide structural integrity to the plug 610. Thus, the segments 620 are firmly held along the centerline "C" (shown in FIG. 6A). However, during destruction, the portion of the plug 610 at the upper end 612 will be readily shattered. The segments 620 will separate from each other at the joints 624 and fall into the wellbore 100 without getting wedged.

In one method of fabricating the plug 610 from the set of joints 620, a starting plug is first molded to near-final dimensions. Next, the starting plug is cut into its separate segments 620. The process of cutting the starting plug will cause a loss of material from half of the segments. Therefore, more than one starting plug is molded and cut. The full-size segments are next bonded together using an adhesive such as an epoxy. After the adhesive hardens, the plug is machined to final dimensions. The adhesive is strong enough to withstand the machining process. This produces the segmented plug 610.

Figure 7A:
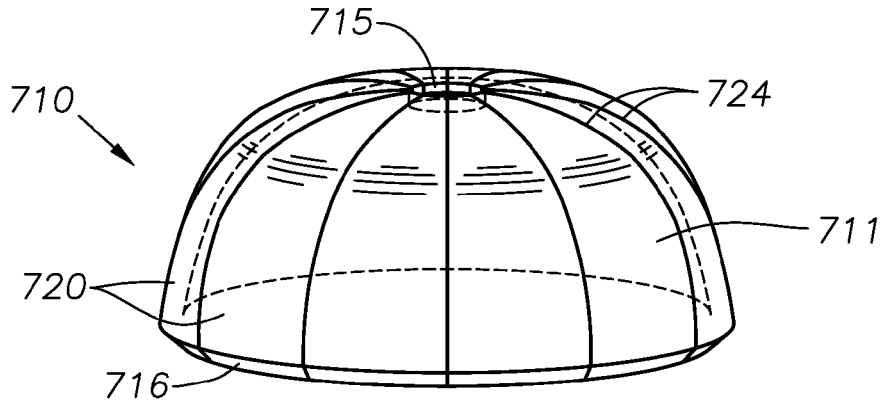
FIG. 7A is a perspective view of a plug for a bridge plug arrangement in accordance with the present invention, in yet an alternate embodiment. Here, the plug is shaped as a dome.

FIG. 7A is a perspective view of a plug for a bridge plug arrangement in accordance with the present inventions, in yet another alternate embodiment. The plug 710 is once again dimensioned to be run into a wellbore 100 and to be seated within a string of casing 106. The plug 710 is designed to isolate a flow of fluids through the wellbore 100 and into a selected formation 114 at a desired subsurface depth.

In the illustrative embodiment of FIG. 7A, the plug 710 is shaped as a dome. In this instance, the dome is semi-spherical; however, other dome shapes may be employed. As with plug 210 of FIG. 2, the dome-shaped plug 710 defines a body 711 that has an upper end 712 and a bottom end 714.

The lower end 714 of the plug 710 defines a beveled surface 716. The beveled surface 716 is preferably angled in order to substantially match with the angle α of a shoulder. The shoulder may be within a liner or tubular member, such as shoulder 656. Alternatively, the shoulder may be at the upper end of a separate seat, such as beveled edge 336 from the seat 330 of FIG. 3A.

The plug 710 also includes a bore 715. The bore 715 extends from a top end 712 to a bottom end 714. The bore 715 receives a mandrel that is part of a running tool. The running tool, in turn, is run into the wellbore 100 using a wireline, coiled tubing, or other device known in the art.

It is understood that the plug 710 need not have a bore for receiving a running tool; instead, the plug 710 may have a hook (not shown) for receiving the running tool. In either instance, the plug 710 is fabricated from a frangible material, such as the ceramic materials listed above. The plug 710 also preferably includes segments 724 for providing a preferential breakage pattern.

The present inventions are not limited to any particular shape for the plug. However, in one aspect, the shape of the plug is optimized to accomplish its dual functions of being able to withstand the high compressive pressures exerted during the injection of a formation stimulating fluid, while being easily destroyed through application of a mechanical force that breaks the plug it into small segments. The use of ceramics allows for considerable flexibility in the design. In this regard, a ceramic body may be molded and then machined to within very fine tolerances.

In connection with optimizing the configuration of the plug, the plug may be, for example, a flat disc having an optimized thickness. In this respect, the disc would be thick enough to provide sufficient compressive strength, but thin enough to allow a set of jars to later break the disc into small pieces. Similarly, cone- or dome-shaped plugs may be configured having varied thicknesses. A variety of modeling techniques and/or experimental techniques may be used to determine an optimized profile or thickness of the various plug configurations described herein. Strength tests have been conducted on disc-shaped plugs fabricated from CoorsTek™ AD94 and AD995 alumina silicate. Ceramic plugs having thicknesses of one inch and 1½ inches have been separately landed onto a ceramic seat in a test chamber. The seat had a conical profile representing an angle α of about 25° off of vertical. An overlap of 0.05 inches of the plug onto the seat was employed. The plug and seat were mechanically tested under loads of up to 200,000 pounds (or 200 kips). This corresponds to 7,120 psi hydrostatic load when using a 7" outer diameter pipe. The plugs were able to withstand this load without failing.

Further physical tests have indicated that an angle α of less than 15° off of vertical created a likelihood of the plug sticking in the seat. In this respect, the plug would slide off of the shoulder and become stuck within the inner diameter of the test pipe. The plug could not be removed without breaking.

In further laboratory testing after the strength test, a plug has also been placed in tension to simulate the pulling of a plug with a wireline. The associated extraction load during testing varied from zero to 1,000 pounds. This is considered an acceptable test range to simulate pulling the disc-shaped plug with wireline. The plug survived the testing in tact.

Of interest, the applicant has observed from testing (and considered intuitively) that a plug may not land precisely on a seat as intended. In this respect, a lower beveled edge of a plug may not mate with the upper beveled edge of the seat when the plug is landed on the seat. However, a substantial fluid seal was still obtained when a hydraulic load was placed on the top surface of the plug. The hydraulic load caused the plug to become self-centralized.

Figure 7B:
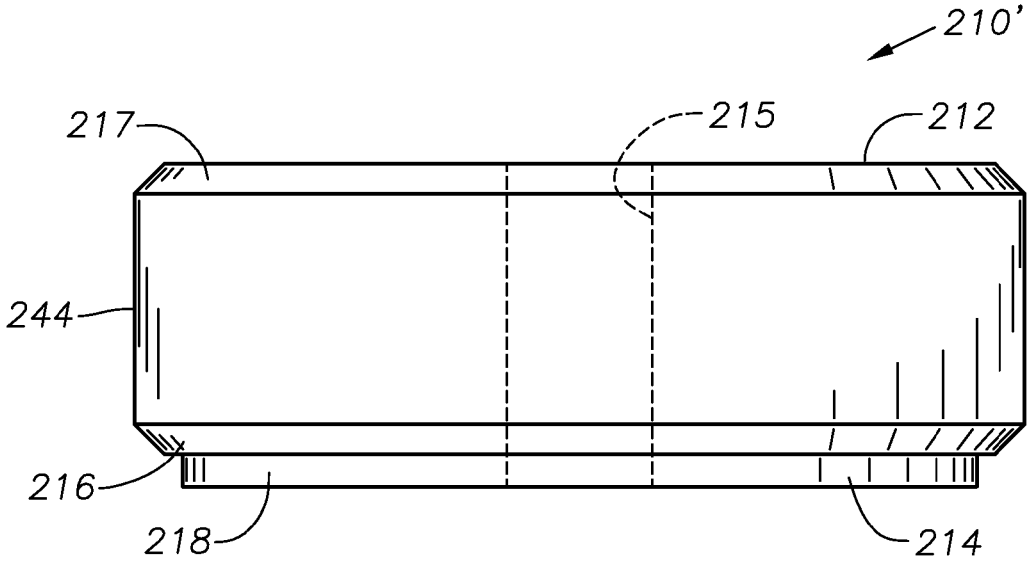
FIG. 7B provides a side view of a plug that may be used in accordance with the present inventions, in yet another alternate embodiment. Here, the plug is shaped as a disc, and has a small stem for self-centralizing.

To further ensure that the plug is self-centralizing, and in an abundance of caution, a small stem may optionally be provided at the lower end of a plug. FIG. 7B provides a side view of a plug 210' that may be used in accordance with the present inventions, in yet another alternate embodiment. The illustrative plug 210' may be substantially the same as plug 210 of FIG. 2A. In this respect, the plug 210' defines a disc-shaped body 244 that has an upper end 212 and a bottom end 214. A cylindrical bore 215 is provided that extends from the upper end 212 to the bottom end 214. The bore 215 is configured to receive a running tool (not shown)

for delivering the plug 210 to a selected depth within a wellbore, such as wellbore 100.

The bottom end 214 of the plug 210' has a beveled edge 216 machined into an outer diameter. The beveled edge 216 is dimensioned to land on a shoulder such as shoulder 246 of FIG. 2A or shoulder 336 of FIG. 3A. The bottom end 214 of the plug 210' also has a small stem 218. The stem 218 extends ⅛th inch to 1 inch below the body 244 of the plug 210'. The stem 218 allows the plug 210' to be self-centralizing.

From the foregoing discussion, it can be understood that the present disclosure provides a bridge plug assembly having at least one frangible component, which component may be the plug, the structure providing a shoulder or seat on which the plug rests, or both. A variety of factors may influence the decision of which component to provide of frangible material, or in breakable form. For example, materials properties, expected well operations, well conditions, etc. may all influence the well operators' decision. Regardless of the manner of constructing the bridge plug assembly, some component will fabricated of frangible material to facilitate the breakage of the component.

Figure 8:
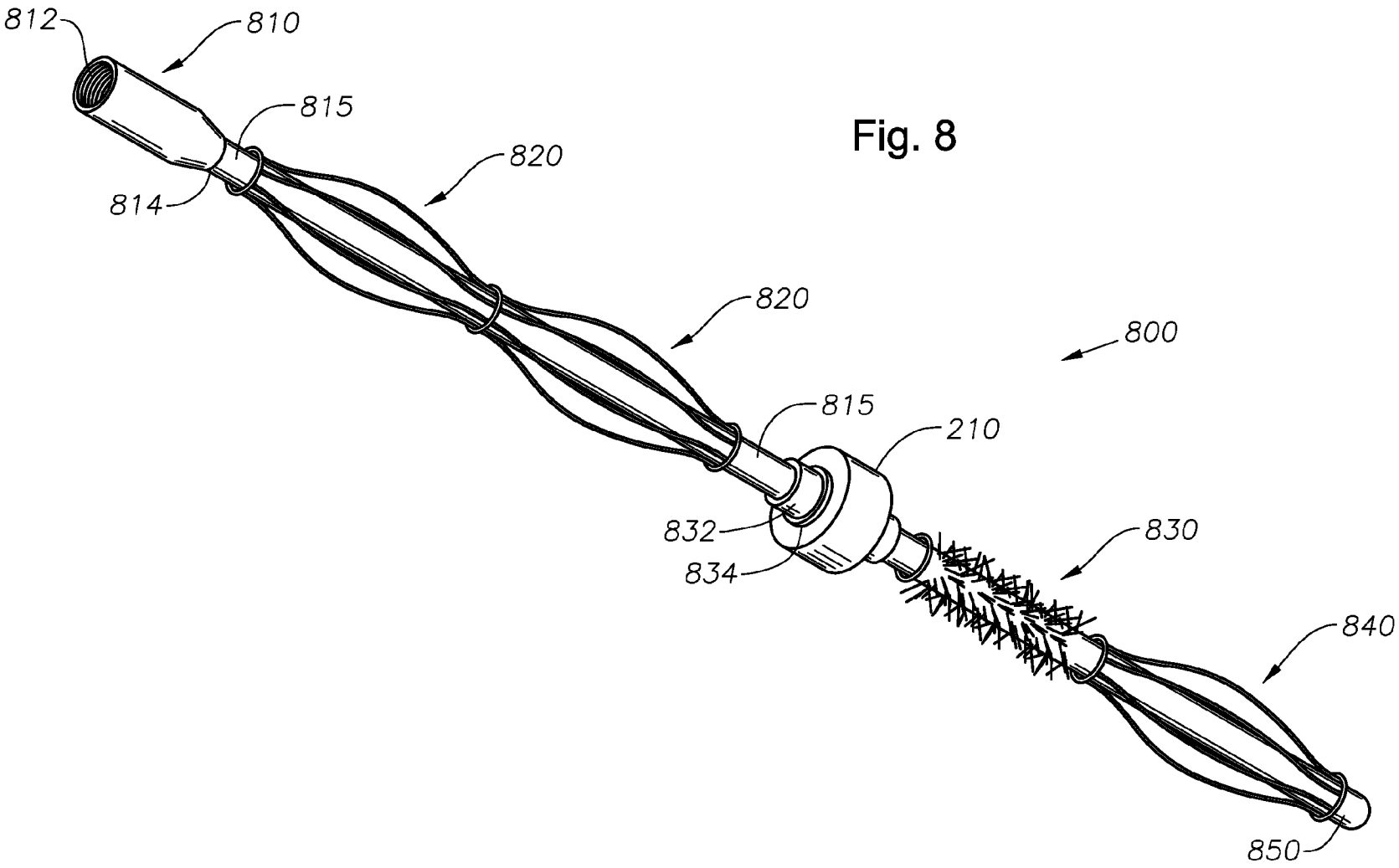
FIG. 8 is a perspective view of a tool string. The tool string presents one arrangement for running in a plug in certain of the arrangements disclosed herein.

FIG. 8 provides a perspective view of a tool string 800. The tool string 800 presents one arrangement for running in a plug as disclosed herein. In the illustrative arrangement of FIG. 8, the plug 210 of FIG. 2A is used. The tool string 800 does not represent all components that may need to be used for running in the plug 210, but provides an example of some components that may be used.

In FIG. 8, the tool string 800 first includes a run-in connection 810. The run-in connection 810 has a threaded upper end 812. This may be used to secure the tool string 800 to a wireline or other running tool mechanism.

The run-in connection 810 also has a lower end 814. The lower end 814 is connected to an elongated mandrel 815. The mandrel 815 defines a cylindrical body that supports the various components of the tool string 800. It is understood that the mandrel 815 may be a single cylindrical body or may be a series of pipes threadedly connected. The mandrel 815 extends to a bottom end 850 below the plug 210. Of interest, the mandrel 815 extends through the bore of the plug 210. (The bore is shown at 215 in FIG. 2A.) A nut 832 and washer 834 are provided to secure the plug 210 along the mandrel 815. While a nut 832 and washer 834 are seen in the perspective view of FIG. 8 only above the plug 210, it is understood that a like nut and washer are provided below the plug 210.

The tool string 800 next comprises one or more centralizers 820. In the illustrative arrangement of FIG. 8, a pair of centralizers 820 is provided above the plug 210. A centralizer 840 may also be provided below the plug 210, as shown in FIG. 8. The centralizers 820, 840 serve to keep the plug 210 within the inner diameter of the casing string 102, 104, 106 during run-in. In addition, the centralizers 820, 840 help make sure that the plug lands properly on the shoulder downhole.

The tool string 800 also includes an optional set of brushes 830. The brushes 830 are disposed below the plug 210. The brushes 830 help to scrape off mud and debris from the inner diameter of the casing string 102, 104, 106 during run-in.

Figure 9A:
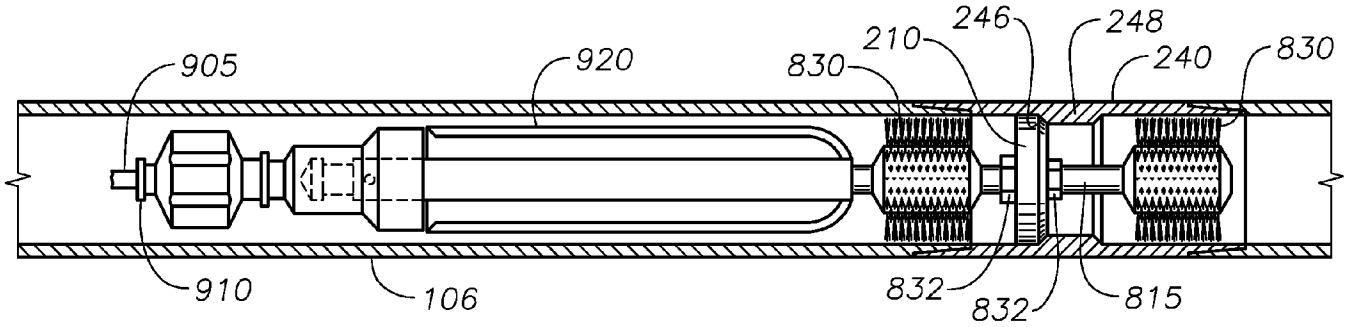
FIGS. 9A, 9B and 9C each present a side view of a tool string that includes a plug. The plug has been landed on a shoulder within a tubular member.
Figure 9B:
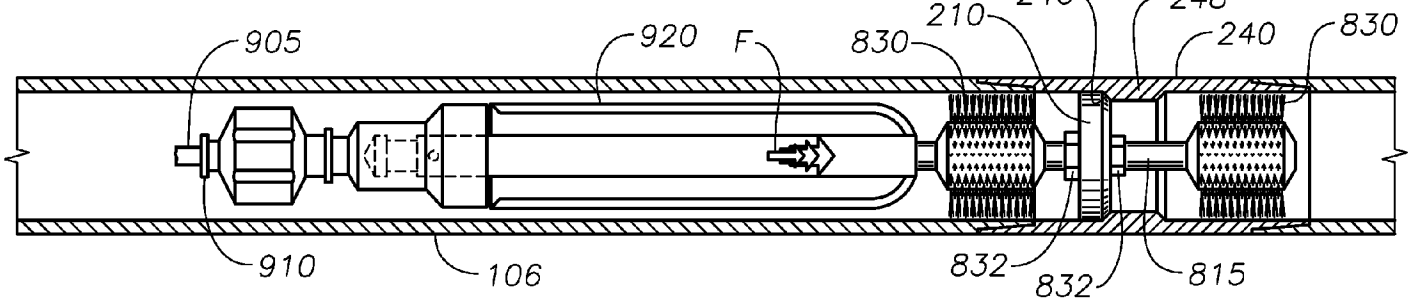
Figure 9C:
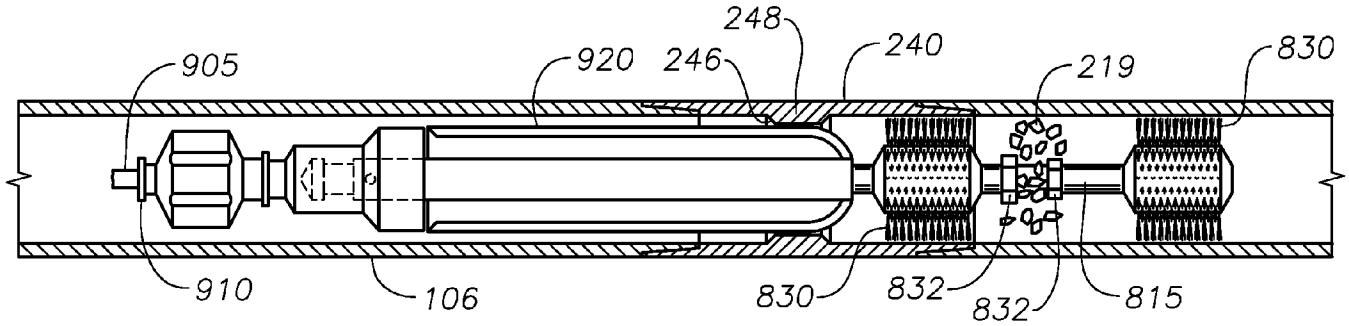

Another arrangement for a tool string is presented in FIGS. 9A, 9B and 9C. FIGS. 9A, 9B and 9C each present a side view of a tool string 900 that includes a plug. The plug may be in accordance with any of the arrangements disclosed herein. In the illustrative arrangement of FIG. 9, the plug 210 of FIG. 2A is once again used.

In each of FIGS. 9A, 9B and 9C, the tool string 900 has been run into a production casing 106. The production casing 106 includes a tubular member, such as tubular member 240. The tubular member 240 has a reduced inner diameter portion 248 forming a shoulder 246. In this instance, the shoulder 246 serves as an integral seat. In FIGS. 9A and 9B, the plug 210 has been landed onto the shoulder 246 to form a substantial fluid seal.

It is noted that the tool string 900 of FIGS. 9A, 9B and 9C is somewhat schematic. The tool string 900 is not intended to show all components that may be used for running in the plug 210, but provides an example of some components that may be used. As with the tool string 800 of FIG. 8, the tool string 900 includes a running tool connection 910. The running tool connection 910 is connected to a wireline 905. The wireline 905 runs to the surface 101 and is used for running the tool string 900 into the wellbore 100.

The tool string 900 includes additional components that are common with the tool string 800. These include a mandrel 815, a nut 832 on either side of the plug 210, and a brush 830 below the plug 210. In addition, the tool string 900 provides an optional brush 830 above the plug 210.

Of interest, the tool string 900 also has a set of jars 920. The jars 920 are used to direct a mechanical force against the plug 210. The force is demonstrated by arrows "F." The force "F" causes the plug 210 to break into small pieces. The pieces are not captured, but are allowed to fall into the rat hole at the bottom of the wellbore 100.

Referring specifically to FIG. 9A, a set of jars 920 is going to be actuated against the mandrel 815. The jars will exert a downward force that will be transmitted through the mandrel 815 and onto the plug 210.

In FIG. 9B, the jars 920 have impacted a head (not shown). Force "F" shows a downward force "F" that is acting on the plug 210. The force "F" is sufficient to break the plug 210 into a plurality of pieces.

In FIG. 9C, the mechanical force "F" generated by the jars 920 has caused the mandrel 815 to drive through the plug 210, causing it to break into pieces. Multiple pieces are shown at 219. The pieces 219 are preferably allowed to fall into the rat hole.

Figure 10:
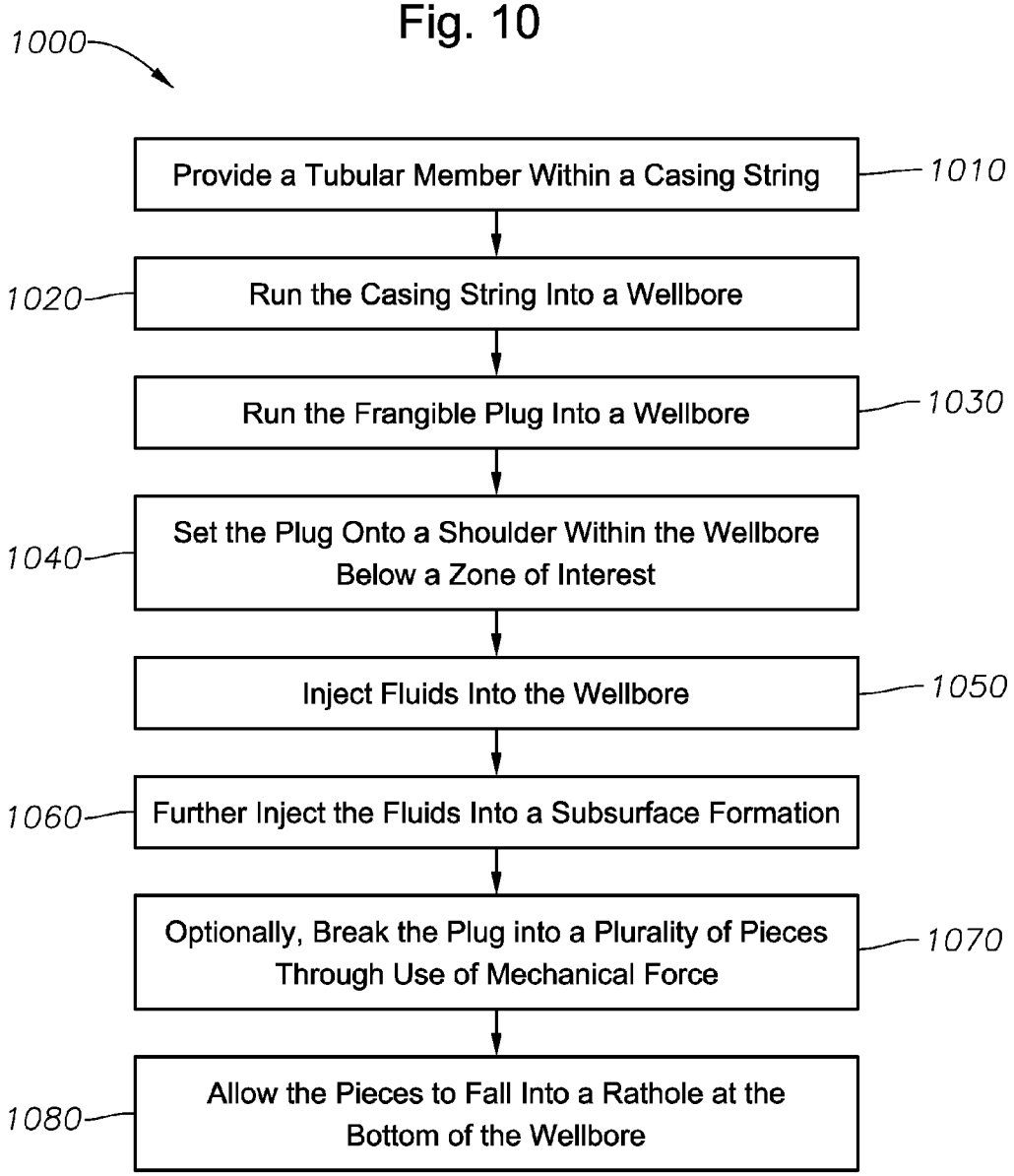
FIG. 10 provides a flowchart for a method of diverting fluids into a subsurface formation in accordance with one embodiment of the present inventions.

As part of the disclosure herein, various methods are provided for diverting fluids into a formation. FIG. 10 provides a flowchart for a method 1000 of diverting fluids into a formation 114 in accordance with one embodiment of the present inventions. The method 1000 is performed by using a frangible bridge plug such as plug 210. The plug serves to divert fluid as may be done during well stimulation or hydraulic fracturing.

The method 1000 includes the step of providing a tubular member within a casing string. This is shown in Box 1010 of FIG. 10. The tubular member may be a short pup joint such as is shown in tubular member 240 of FIG. 2A. Alternatively, the tubular member may itself be a joint of casing or other longer pipe. In either instance, the tubular member is tied into the casing string (such as liner string 106) through a threaded or other connection.

The method 1000 also includes running the casing string into the wellbore. This is presented in Box 1020. The casing string includes the tubular member. The tubular member, in turn, includes a radial shoulder such as shoulder 246 from FIG. 2A. The tubular member and radial shoulder are positioned in the wellbore 100 such that the tubular member is below a formation or zone of interest. The term "radial shoulder" is defined broadly to include substantially any shape for receiving the plug engagement thereon, including but not limited to rounded, chamfered, beveled, angled, flat (e.g., normal to the tubular member or substantially parallel with the bottom plane of the plug) or otherwise shaped, so long as the shoulder on the "up-hole" side of the radial shoulder has at least some portion or component facing that faces the plug, such that the plug does not rely wholly upon a seal-bore or seal-bore-like function to form the seal. Stated differently, the radial shoulder should engage with a bottom side face-portion of the plug.

The method 1000 further includes running a bridge plug into a wellbore. This is represented by Box 1030. The bridge plug may be any plug configured to be run into a wellbore 100 and landed on a shoulder. Thus, the plug may be, for example, any of plugs 210, 610 or 710 disclosed above. Regardless of the configuration of the bridge plug, it is fabricated from a frangible material, that is, a material that can be broken into pieces upon the application of a mechanical force downhole.

The method 1000 also comprises landing the bridge plug on the radial shoulder within the wellbore 100. This step is indicated at Box 1040. The radial shoulder may be, for example, shoulder 246 associated with reduced inner diameter portion 248 from FIG. 2B, or shoulder 656 associated with reduced inner diameter portion 654 from FIG. 6B. Alternatively, the radial shoulder may be, for example, beveled edge 336 associated with seat 330 from FIG. 3B. The shoulder of a tubular member or the beveled edge of a seat, as the case may be, mates flush, or at least substantially flush, with a beveled edge along the plug, such as beveled edge 216 from plug 210.

It is noted that step 1040 of method 1000 is not limited to the use of a plug and radial shoulder having mating beveled edges. Instead, the radial shoulder may simply be a reduced inner diameter having a 90 degree step, where a flat plug surface rests on the step.

The method 1000 next includes injecting fluids into the wellbore. This is represented at Box 1050. The fluids may be an acid or other formation treating solution as may be used during a well stimulation procedure. Alternatively, the fluids may be a hydraulic fracturing fluid.

The method 1000 also includes the step of further injecting the fluids into a subsurface formation located above the radial shoulder. This step is provided in Box 1060. In this step 1060, the majority of injected fluids are diverted into the formation. The formation may be, for example, formation 114 in wellbore 100.

The method 1000 next includes optionally breaking the plug into a plurality of pieces. Other optional steps may include leaving the plug in place w/o intentionally breaking it, or retrieving it, such as on a wireline, retrieving tool, retrieving it using a tubular string, or even reverse circulating it out of the hole. The step of optionally breaking the plug is shown in Box 1070 of FIG. 10B. The step 1070 is accomplished by applying a mechanical force to the frangible plug. The force may be applied through a set of jars, such as jars 910. Alternatively, the force may be applied through a spear or other mechanical device.

It is understood that the operator may optionally pull the bridge plug off of the seat and retrieve it to the surface. However, the step 1070 remains an option to the operator in the event the plug becomes hung up, or in the event the operator wishes to simply destroy the plug and pull the running tool string (such as string 800) expeditiously. In the case that the plug is being pulled but gets stuck, the jars are activated and the plug is destroyed.

In the event that step 1070 is performed, the method 1000 further includes allowing the pieces to fall into a rat hole. The rat hole refers to the bottom of the wellbore 100, as indicated in FIG. 1 at 130. This step is provided in Box 1080.

In an alternative method, the plug is fabricated from either a frangible or a non-frangible material. Examples of non-frangible materials include aluminum, steel or a composite. In this alternative method, a separate or non-integral seat is placed along the tubular member. An example is seat 330 of FIGS. 3A and 3B. In this instance, the seat is preferably landed within a recess machined into an inner diameter of the tubular member. An example is the recess 348 of body 340 in FIG. 3B.

In this alternative method, after the treatment fluids have been diverted into a formation, and after the plug has been pulled from the wellbore or optionally destroyed, the seat may optionally be destroyed. The step of destroying the seat may be conducted by applying a mechanical force, such as through a spear that is run through the wellbore. Alternatively, the seat may be destroyed through application of shaped charges or other explosive. As noted above in connection with FIG. 4A, the seat is preferably fabricated from a frangible material that is pre-scribed or even fabricated from segments to assist in preferential breakage of the seat.

The present inventions also include a method for installing a seat in a tubular member. In this method, the seat is fabricated from a ceramic material while the tubular member is fabricated from a metallic material. The ceramic material may be any of the materials described above as being ceramic, while the metal materials may comprise steel or any metal alloy as may be used for downhole piping.

The method for installing a seat employs an interference fit between the seat and the surrounding tubular member. The interference fit between the seat and the tubular member exploits the contrast in coefficient of thermal expansion between the ceramic material making up the seat and the metal material making up the tubular member.

First, the seat is fabricated as either a solid cylindrical body or a segmented body as described above. The seat may be, for example, seat 330 from FIG. 3A or seat 400 from FIG. 4B. However, in this method the final outer diameter of the seat is the same as or slightly larger than an inner diameter or bore of the tubular member.

Next, the tubular member is heated to a temperature high enough to cause the inner diameter of the tubular member to expand above the outer diameter of the ceramic seat. Then, using tools and, as appropriate, thermally protective gear, the ceramic seat is installed into the bore of the tubular member. The seat is temporarily held in place and the tubular member is allowed to cool. As the tubular member cools, the inner diameter of the bore returns to its original dimension. This, in turn, creates a compressive friction fit that frictionally locks the ceramic seat in place.

It is preferred that during the heating process, the seat is also heated. In this way, the ceramic material will not undergo cracking due to thermal shock when it is placed into contact with the heated tubular member. Because the coefficient of thermal expansion of the seat is less than that of the tubular member, heating the seat will not create a significant change in its outer diameter. Thus, the seat is able to be placed within the bore of the heated tubular member even though the seat itself has also been heated.

Figure 11:
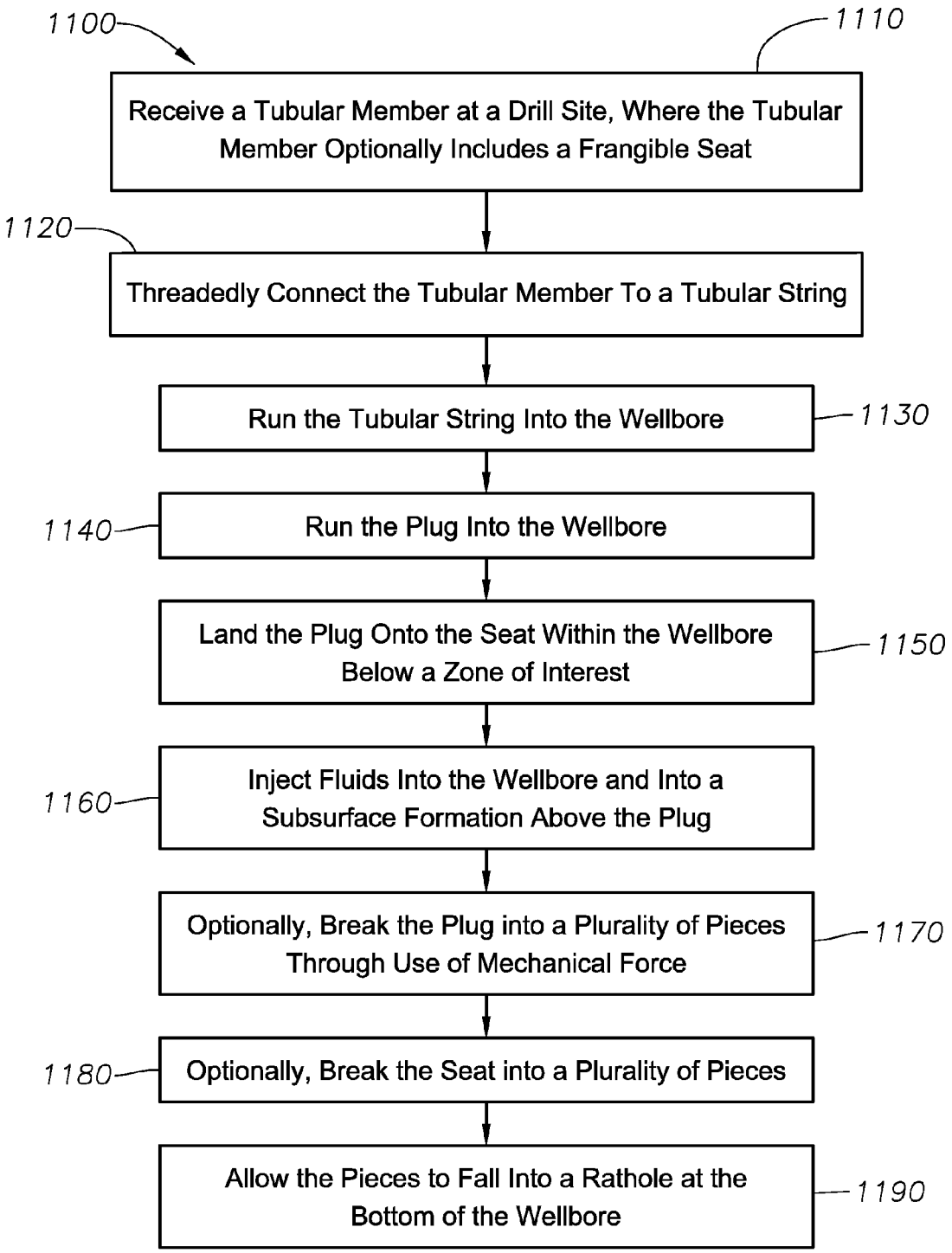
FIG. 11 presents a flowchart showing steps that may be performed in accordance with a method for landing a plug on a seat within a wellbore, in one embodiment.

Using the above method for installing a seat, a method 1100 for landing a plug on a seat within a wellbore 100 is also provided. FIG. 11 presents a flowchart showing steps that may be performed in accordance with the method 1100, in one embodiment.

In one aspect, the method 1100 includes receiving a tubular member at a drill site. This is shown at Box 1110 of FIG. 11. The tubular member has been fabricated from a metallic material having a first coefficient of thermal expansion. The tubular member includes a bore forming an inner diameter, and a circumferential seat held within the tubular member by means of compressive forces.

The seat has been fabricated from a ceramic material having a second coefficient of thermal expansion. The second coefficient of thermal expansion is less than the first coefficient of thermal expansion. The seat has been placed into the bore of the tubular member after the tubular member has been heated such that an outer diameter of the seat is greater than the inner diameter of the tubular member when the tubular member is at ambient temperature, but is less than the inner diameter of the tubular member when the tubular member is heated to a temperature greater than a subsurface temperature.

The method 1100 also includes connecting the tubular member to a casing string. This is provided in Box 1120. Preferably, the connecting step 1120 is performed by threadedly connecting the tubular member to the casing string. In addition, the method 1100 includes running the casing string into the wellbore, and running the plug into the wellbore. These steps are shown in Boxes 1130 and 1140, respectively.

The method then includes landing the plug on the seat in the tubular member. This is presented in Box 1150. In the context of an acidization operation, the plug does not require a positive hydraulic seal with the seat. The seat resides below a formation or zone of interest that is selected to receive treating fluids. Thereafter, a fluid diversion operation may be conducted in order to treat the subsurface formation with the treating fluids. The step of conducting the fluid diversion operation is provided in Box 1160.

It is preferred that the seat generally be configured in accordance with seat 400 of FIG. 4A. In this respect, the seat includes a beveled edge along an inner diameter proximate an upper end of the seat for receiving the plug. It is also preferred that the plug include an upper end, a bottom end, and a beveled edge along an outer diameter proximate the bottom end of the plug. The beveled edge proximate the bottom end of the plug and the beveled inner diameter of the seat preferably each define an angle $\alpha$ that is between 5 degrees and 75 degrees relative to a centerline through the tubular member. More preferably, the angle is between 15 degrees and 30 degrees. In any instance, it is desirable that the angle of the beveled edge proximate the bottom end of the plug and the angle of the beveled inner diameter of the cylindrical seat are substantially the same.

The tubular member may be any tubular member as described above. For example, the tubular member may be a joint of casing. Alternatively, the tubular member may be a pup joint having a length of about two to ten feet.

In one aspect, the method 1100 further comprises breaking the plug into a plurality of pieces through use of a downward mechanical force. This is shown as an optional step at Box 1170. It is understood that the operator may choose to retrieve the plug intact using a wireline or other retrieval tool. However, if the plug gets stuck after the stimulation operation and during retrieval, the plug may be destroyed using a set of jars.

After the stimulation operation, the seat may also optionally be independently destroyed. This is shown in Box 1180. The broken pieces of the plug and the seat are allowed to fall into a rat hole at the bottom of the wellbore. This is provided in Box 1190. Breaking the seat provides full access to the wellbore.

The following table presents exemplary, non-limiting options for destruction of the plug and/or the seat, depending on the materials used:

| Plug Material | Seat Material | Destruction Method |
|---|---|---|
| Ceramic (or other frangible material) | Steel - shoulder machined into the inner diameter of the casing as an integral seat | Plug may be destroyed by wireline tool |
| Ceramic (or other frangible material) | Ceramic (or other frangible material) | Both plug and seat may be destroyed by wireline tool |
| Steel (or other non-frangible material) | Ceramic (or other frangible material) | Seat may be destroyed by wireline tool; plug retrieved to surface |

While it will be apparent that the inventions herein described are well calculated to achieve the benefits and advantages set forth above, it will be appreciated that the invention is susceptible to modification, variation and change without departing from the scope of the claims, as set forth below.

What is claimed is:

1. A bridge plug arrangement, comprising:

a plug having an upper end, a bottom end, and a beveled edge along an outer diameter proximate the bottom end of the plug;

a tubular member for receiving the plug, the tubular member having an upper end, a bottom end, and a bore extending from the upper end to the bottom end;

a shoulder disposed along an inner diameter of the tubular member below said upper end and configured to receive the beveled edge of the plug; and one of a bore defined by a body of the plug, the bore extending from the upper end to the bottom end and configured to receive a running tool, or a hook extending from the upper end and configured to receive a running tool;

wherein the plug and is fabricated of frangible material.

2. The bridge plug arrangement of claim 1, wherein the shoulder is provided by a reduced inner diameter portion machined into the tubular member.

3. The bridge plug arrangement of claim 2, wherein:

the plug defines a body that is shaped as a dome or as a cone;

the bottom end of the body defines an angle relative to the centerline of the plug; and the angle of the bottom end of the body is essentially the same as the angle of the shoulder of the reduced inner diameter portion so as to counteract any hydraulic forces applied downwardly against the plug.

4. The bridge plug arrangement of claim 1, wherein the frangible material is selected from ceramic, glass, plastic, or combinations thereof.

5. The bridge plug arrangement of claim 1, wherein the plug is shaped as a disc.

6. The bridge plug arrangement of claim 5, wherein the plug further comprises a stem extending from the bottom end of the plug, the stem helping to centralize the plug within the tubular member during use.

7. The bridge plug arrangement of claim 6, wherein the stem is about ⅛th inch to 1 inch in length.

8. The bridge plug arrangement of claim 1, wherein the plug defines a body that is shaped as a cone or as a dome.

9. The bridge plug arrangement of claim 8, wherein the plug has a non-uniform thickness.

10. The bridge plug arrangement of claim 8, wherein the body is assembled from a series of segments that are weakly joined together along joints, thereby accommodating the breakage of the plug downhole by application of a mechanical force.

11. The bridge plug arrangement of claim 10, wherein the joints are bonded together using an adhesive.

12. The bridge plug arrangement of claim 1, further comprising:

a threaded mandrel that extends through the bore in the plug;

a first nut threaded onto the mandrel and secured adjacent the upper end of the plug; and a second nut threaded onto the mandrel and secured adjacent the bottom end.

13. The bridge plug arrangement of claim 12, wherein:

the shoulder is provided by a separate cylindrical seat disposed along an inner diameter of the tubular member;

the cylindrical seat comprises a beveled inner diameter proximate an upper end of the cylindrical seat, and a beveled outer diameter proximate a bottom end of the cylindrical seat; and the plug lands upon the beveled inner diameter proximate the upper end of the cylindrical seat.

14. The bridge plug arrangement of claim 13, wherein the cylindrical seat is fabricated from a frangible material.

15. The bridge plug arrangement of claim 13, wherein:

the tubular member further comprises an enlarged inner diameter portion forming a recess, the recess having a lower beveled edge for receiving the beveled outer diameter proximate the bottom end of the cylindrical seat; and the cylindrical seat is placed in the recess.

16. The bridge plug arrangement of claim 15, further comprising:

an elastomeric ring placed between the seat and the lower beveled edge of the tubular member to provide a positive hydraulic seal between the seat and the lower beveled edge of the tubular member.

17. The bridge plug arrangement of claim 15, further comprising:

a securement ring that connects onto threads within the recess of the tubular member proximate the upper end of the seat to secure the seat into place on the lower beveled edge of the tubular member.

18. The bridge plug arrangement of claim 15, wherein:

an angle of the beveled edge proximate the bottom end of the plug and the angle of the beveled inner diameter proximate the upper end of the seat are each between about 15 degrees and 75 degrees relative to the centerline; and the angle between the beveled outer diameter proximate the bottom end of the seat and an angle of the lower beveled edge of the tubular member are each between about 15 degrees and 75 degrees relative to the centerline.

19. The bridge plug arrangement of claim 18, wherein:

the plug defines a body that is shaped as a dome or as a cone;

the bottom end of the body defines an angle relative to the centerline of the plug; and the angle of the bottom end of the body is essentially the same as the angle of the beveled inner diameter proximate the upper end of the cylindrical seat so as to counteract hydraulic forces that may be applied downwardly against the plug.

20. The bridge plug arrangement of claim 18, wherein the angle of the beveled edge proximate the bottom end of the plug and the angle of the beveled inner diameter proximate the upper end of the seat are substantially the same; and wherein the angle of the beveled outer diameter proximate the bottom end of the seat and the angle of the lower beveled edge within the recess of the tubular member are substantially the same.

21. The bridge plug arrangement of claim 1, wherein:

the beveled edge proximate the bottom end of the plug and the shoulder along the tubular member each define an angle that is between 15 degrees and 75 degrees relative to a centerline through the tubular member; and the angle of the beveled edge proximate the bottom end of the plug and the angle of the shoulder are substantially the same.

22. The bridge plug arrangement of claim 21, wherein:

the beveled edge of the plug lands upon the shoulder of the tubular member; and the angle of the beveled edge proximate the bottom end of the plug and the angle of the shoulder of the tubular member are each between about 15 degrees and 35 degrees relative to the centerline.

23. The bridge plug arrangement of claim 22, further comprising:

an elastomeric ring between the plug and the shoulder of the tubular member to provide a hydraulic seal between the plug and the shoulder of the tubular member.

24. The bridge plug arrangement of claim 1, wherein the beveled edge forms a substantial hydraulic seal between the plug and the tubular member.

25. A method for diverting fluids in a wellbore, comprising:

providing a tubular member within a casing string, the tubular member comprising a beveled shoulder machined into an inner diameter of the tubular member;

running a plug into the wellbore, the plug comprising an upper end, a bottom end, and a beveled edge along an outer diameter proximate the bottom end of the plug;

setting the plug onto a seating shoulder below a subsurface zone of interest, the seating shoulder defining an angle relative to a centerline of the tubular member;

injecting a fluid into the tubular member, the majority of fluid being blocked from travel below the plug, and being diverted through an aperture in the tubular member above the plug; and optionally breaking the plug into pieces after injecting the fluid.

26. The method of claim 25, wherein:

the plug is fabricated from a frangible material;

the beveled shoulder in the tubular member is part of an enlarged inner diameter portion of the tubular member;

setting the plug onto a seating shoulder comprises landing the beveled edge of the plug onto the beveled shoulder of the tubular member; and the angle of the beveled edge proximate the bottom end of the plug and the angle of the beveled shoulder of the tubular member are each between about 15 degrees and 75 degrees relative to the centerline.

27. The method of claim 26, wherein an elastomeric ring is provided between the plug and the beveled shoulder of the tubular member to provide a positive hydraulic seal when the plug is set upon the beveled shoulder of the tubular member.

28. The method of claim 25, further comprising:

disposing a cylindrical seat onto the beveled shoulder of the tubular member prior to running the plug into the wellbore, the seat being fabricated from a frangible material, and the seat comprising a beveled inner diameter proximate an upper end of the seat, and a beveled outer diameter proximate a bottom end of the seat;

and wherein:

the beveled shoulder in the tubular member is part of an enlarged inner diameter portion of the tubular member that defines a recess so that the cylindrical seat resides within the recess;

the seating shoulder defines the beveled inner diameter proximate the upper end of the cylindrical seat; and setting the plug onto a seating shoulder comprises landing the beveled edge of the plug onto the beveled inner diameter proximate the upper end of the seat.

29. The method of claim 28, wherein:

the angle of the first beveled edge proximate the bottom end of the plug and the angle of the beveled inner diameter proximate the upper end of the seat are each between about 15 degrees and 75 degrees relative to the centerline;

the angle of the first beveled edge proximate the bottom end of the plug and the angle of the beveled inner diameter proximate the upper end of the cylindrical seat are substantially the same;

the beveled outer diameter proximate the bottom end of the seat and the beveled shoulder of the tubular member each define an angle that is between 15 degrees and 75 degrees relative to a centerline through the tubular member; and the angle of the beveled edge outer diameter proximate the bottom end of the seat and the angle of the beveled shoulder of the tubular member are substantially the same.

30. The method of claim 29, wherein an elastomeric ring is placed between the seat and the beveled shoulder of the tubular member to provide a positive hydraulic seal between the seat and the beveled shoulder of the tubular member.

31. The method of claim 29, further comprising:

threading a securement ring onto threads within the recess of the tubular member proximate the upper end of the seat to secure the seat into place within the recess of the tubular member.

32. The method of claim 25, wherein the fluids comprise an acid for formation stimulation, or a proppant for hydraulic fracturing.

33. The method of claim 25, wherein running the plug into the wellbore is performed by using a wireline or coiled tubing.

34. The method of claim 25, wherein the downward mechanical force is provided by activating a set of jars or by releasing a spear.

35. The method of claim 25, further comprising breaking the plug using a downward mechanical force upon the plug.

36. The method of claim 25, further comprising allowing the broken pieces to fall into a rat hole at the bottom of the wellbore or into a basket on the tubular member.

37. A method for fabricating a seat for receiving a plug within a wellbore, comprising:

fabricating at least two cylindrical starter seats from a frangible material, each starter seat having an original outer diameter;

cutting each of the at least two starter seats into a plurality of segments, with selected segments being sized to an original radial dimension which, when combined, form an outer diameter that substantially matches the original outer diameter of the starter seats;

joining a plurality of the selected segments to create a segmented cylindrical seat; and milling the segmented cylindrical seat to have (i) a beveled outer diameter along a bottom end that will land on a radial shoulder within a tubular member, and (ii) a beveled inner diameter along an upper end that will receive a radial plug.

38. The method of claim 37, wherein the frangible material comprises at least one of ceramic, glass, and thermoplastic material.

39. The method of claim 37, wherein joining a plurality of selected segments is performed by using an adhesive.

40. The method of claim 37, wherein:

the radial plug comprises an upper end, a bottom end, and a beveled edge along an outer diameter proximate the bottom end of the plug; and milling the segmented cylindrical seat comprises providing a beveled inner diameter proximate an upper end of the seat configured to receive the beveled edge along the bottom end of the plug.

41. The method of claim 40, wherein:

the beveled edge proximate the bottom end of the plug and the beveled inner diameter of the cylindrical seat each define an angle that is between 15 degrees and 75 degrees relative to a centerline though the seat; and the angle of the beveled edge proximate the bottom end of the plug and the angle of the beveled inner diameter of the cylindrical seat are substantially the same.

42. A method for landing a plug on a seat within a wellbore, comprising:

receiving a tubular member at a drill site, the tubular member having a bore forming an inner diameter, and a circumferential shoulder along the inner diameter;

receiving a radial seat at the drill site, the seat being fabricated from a frangible material, and the radial seat having at least one segment missing to prevent the seat from being circumferential;

turning the radial seat sideways;

lowering the radial seat into the bore of the tubular member;

rotating the seat and placing it upon the circumferential shoulder;

inserting the at least one missing segment into the seat so as to cause the seat to become circumferential;

connecting the tubular member to a production casing;

running the production casing into the wellbore;

running the plug into the wellbore; and landing the plug on the seat in the tubular member.

43. The method of claim 42, wherein:

the tubular member comprises a threaded upper end and a threaded lower end; and connecting the tubular member to the production casing is done by threadedly connecting the tubular member to the production casing.

44. The method of claim 42, wherein the circumferential shoulder within the bore of the tubular member is part of a reduced inner diameter portion of a body of the tubular member.

45. The method of claim 42, wherein the circumferential shoulder within the bore of the tubular member is part of an enlarged inner diameter portion of a body of the tubular member such that the seat is placed within a recess of the tubular member.

46. The method of claim 42, wherein the frangible material of the seat is ceramic, glass, plastic, or combinations thereof.

47. The method of claim 46, wherein the plug is fabricated from either a frangible material or a non-frangible material.

48. A method for landing a plug on a seat within a wellbore, comprising:

receiving a tubular member at a drill site, the tubular member being fabricated from a metallic material having a first coefficient of thermal expansion, and the tubular member comprising:

a bore forming an inner diameter, and a circumferential seat held within the tubular member by an interference fit, the seat being fabricated from a ceramic material having a second coefficient of thermal expansion that is less than the first coefficient of thermal expansion, and wherein the seat has been placed into the bore of the tubular member after the tubular member has been heated such that:

an outer diameter of the circumferential seat is greater than the inner diameter of the tubular member when the tubular member is at ambient temperature, but is less than the inner diameter of the tubular member when the tubular member is heated to a temperature greater than a subsurface temperature;

connecting the tubular member to a production casing;

running the production casing into the wellbore;

running the plug into the wellbore; and landing the plug on the seat in the tubular member.

49. The method of claim 48, wherein the seat is fabricated from a frangible material; and the method further comprises:

breaking the seat into a plurality of pieces through use of a mechanical force; and allowing the broken pieces of the seat to fall into a rat hole at the bottom of the well bore.

50. The method of claim 49, wherein the plug is also fabricated from a frangible material; and the method further comprises:

breaking the plug into a plurality of pieces through use of a mechanical force; and allowing the broken pieces of the plug to fall into the rat hole at the bottom of the well bore.

* * * * *